US010875333B2

(12) United States Patent
Shimomura et al.

(10) Patent No.: US 10,875,333 B2
(45) Date of Patent: Dec. 29, 2020

(54) RECORDING APPARATUS

(71) Applicant: SEIKO EPSON CORPORATION, Tokyo (JP)

(72) Inventors: Masaki Shimomura, Matsumoto (JP); Hiroshi Shiohara, Shiojiri (JP); Akira Nakazawa, Azumino (JP)

(73) Assignee: Seiko Espon Corporation, Tokyo (JP)

( * ) Notice: Subject to any disclaimer, the term of this patent is extended or adjusted under 35 U.S.C. 154(b) by 4 days.

(21) Appl. No.: 16/287,487

(22) Filed: Feb. 27, 2019

(65) Prior Publication Data

US 2019/0263159 A1 Aug. 29, 2019

(30) Foreign Application Priority Data

Feb. 28, 2018 (JP) ..... 2018-034422
Oct. 23, 2018 (JP) ..... 2018-198982

(51) Int. Cl.

| | |
|---|---|
| ***B41J 25/34*** | (2006.01) |
| ***B41J 29/377*** | (2006.01) |
| ***B41J 29/38*** | (2006.01) |
| ***B41J 19/20*** | (2006.01) |

(52) U.S. Cl.
CPC ..... *B41J 29/377* (2013.01); *B41J 19/202* (2013.01); *B41J 25/34* (2013.01); *B41J 29/38* (2013.01)

(58) Field of Classification Search
CPC . B41J 19/202; B41J 25/34; B41J 29/38; B41J 29/377
See application file for complete search history.

(56) References Cited

U.S. PATENT DOCUMENTS

2014/0009550 A1 1/2014 Togo et al.
2017/0246869 A1 8/2017 Shirota et al.

FOREIGN PATENT DOCUMENTS

JP 2004-034659 A 2/2004
JP 2014-014943 A 1/2014
JP 2017-149082 A 8/2017

*Primary Examiner* — Lamson D Nguyen
(74) *Attorney, Agent, or Firm* — Workman Nydegger

(57) ABSTRACT

An ink jet type printer includes a recording head that performs recording on a paper sheet by ejecting ink, a carriage that reciprocates in a width direction while supporting the recording head, and a power supply unit that supplies electricity to driving targets including a driving source of the carriage and the recording head. The power supply unit is disposed such that at least a part thereof overlaps with a moving region of the carriage on an upper side.

13 Claims, 22 Drawing Sheets

RECORDING APPARATUS

CROSS REFERENCES TO RELATED APPLICATIONS

The entire disclosure of Japanese Patent Application Nos. 2018-34422, filed Feb. 28, 2018 and 2018-198982, filed Oct. 23, 2018 are expressly incorporated by reference herein.

BACKGROUND

1. Technical Field

The present disclosure relates to a recording apparatus such as, for example, an ink jet type printer or the like.

2. Related Art

In the related art, a recording apparatus of this type as described in JP-A-2014-14943, for example, is known. Such a recording apparatus includes a power supply unit disposed in a housing of the apparatus main body, a carriage disposed in the housing, and a recording head attached to a lower portion of the carriage. Then, printing of a paper sheet is performed by ejection of an ink droplet from a nozzle of a recording head onto a paper sheet transported along a predetermined transport path, while the carriage is made to reciprocate in the main scanning direction by the electricity supplied from the power supply unit.

However, in the recording apparatus described above, the power supply unit is disposed at the lower portion in the housing, so that when ink leaks in the housing, there is a problem that the leaking ink may penetrate into the power supply unit into a bottom surface, a wall surface, a structure or the like in the housing.

SUMMARY

According to an aspect of the disclosure, a recording apparatus includes a recording head that performs recording on a recording medium by ejecting a liquid, a carriage that reciprocates in one direction while supporting the recording head, and a power supply unit that supplies electricity to driving targets including a driving source of the carriage and the recording head, in which the power supply unit is disposed such that at least a part thereof overlaps with a moving region of the carriage on an upper side.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Hereinafter, a first embodiment of the recording apparatus will be described with reference to the drawings.

Figure 1:
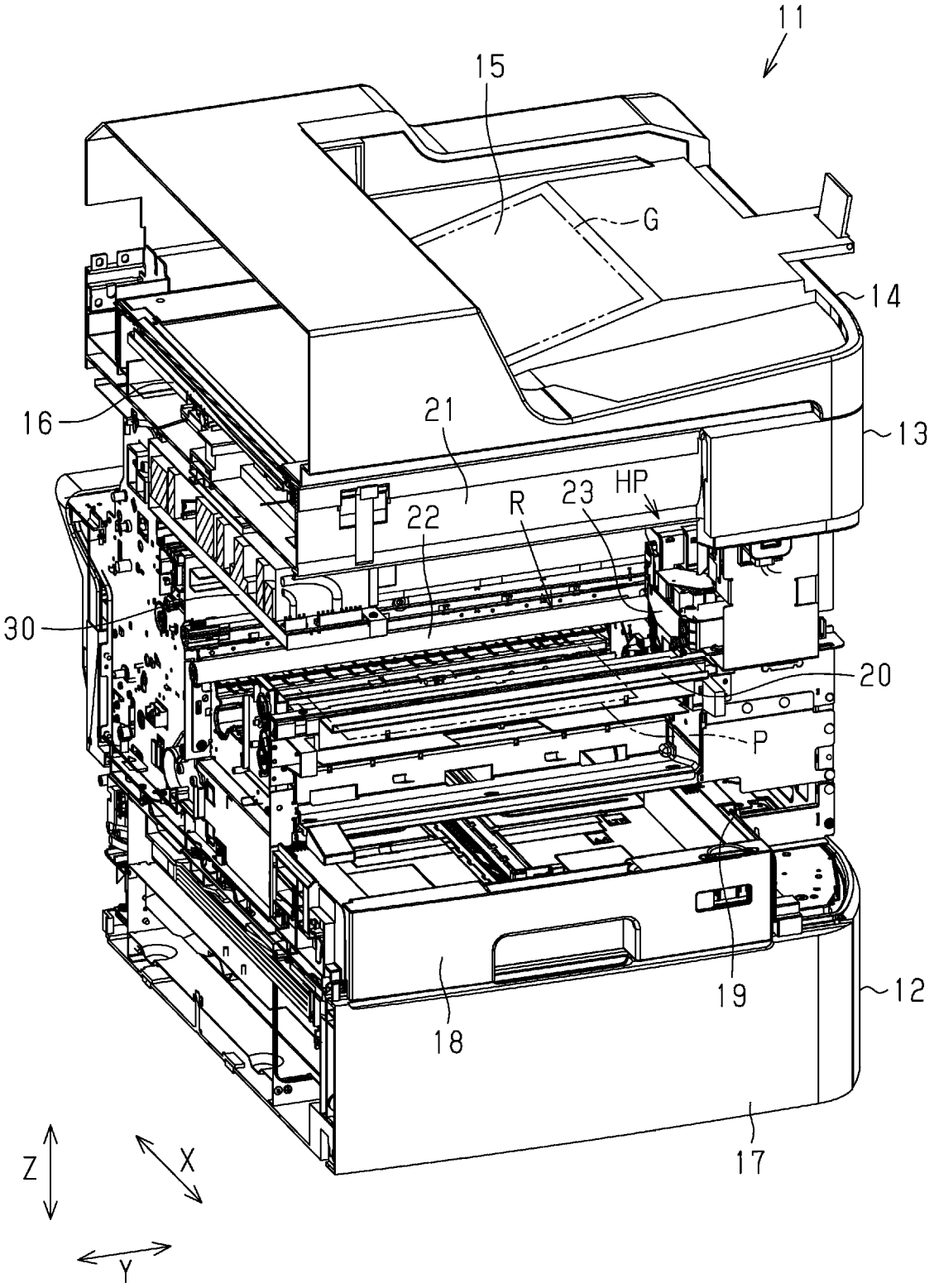
FIG. 1 is a perspective view showing an ink jet type printer in accordance with a first embodiment seen from the front, with a part thereof cut off.

As shown in FIG. 1, an ink jet type printer 11 as an example of a recording apparatus includes a casing 12 installed at a horizontal use place and having predetermined height, depth and width respectively, a document reading device 13 disposed on top of the casing 12, and an automatic document feeding device 14 disposed on top of the document reading device 13.

The automatic document feeding device 14 includes a set section (not shown) in which a plurality of documents G can be set in a stacked state and a discharge section 15 disposed on a lower side of the set section. A plurality of document G set in the set section in a stacked state are read by an image reading section 16 disposed in a document reading device 13 through a process of being sequentially fed to a discharge section 15 through a document feed path (not shown) reversed. As the image reading section 16, a contact type image sensor module (CISM: contact image sensor module) can be used.

At a front portion of the casing 12, from the lower side upwards, an opening/closing cover 17, a mounting port 19 to which a paper cassette 18 which accommodates paper sheet P, which is an example of a recording medium, is attachably/detachably mounted, a discharge port 20 from which a printed paper sheet P is discharged, and an attachment section 21 to which an operation panel (not shown) that performs a variety of operations is attached are provided. The front surface of the casing 12 has height and width and serves as a side surface on which a user mainly operates the ink jet type printer 11. Further, in the present embodiment, a direction parallel to a discharge direction in which the paper sheet P is discharged from the discharge port 20 is defined as a depth direction X, a direction orthogonal to both the depth direction X and the vertical direction Z is defined as a width direction Y. The depth direction X and the width direction Y go along a horizontal plane practically.

Figure 2:
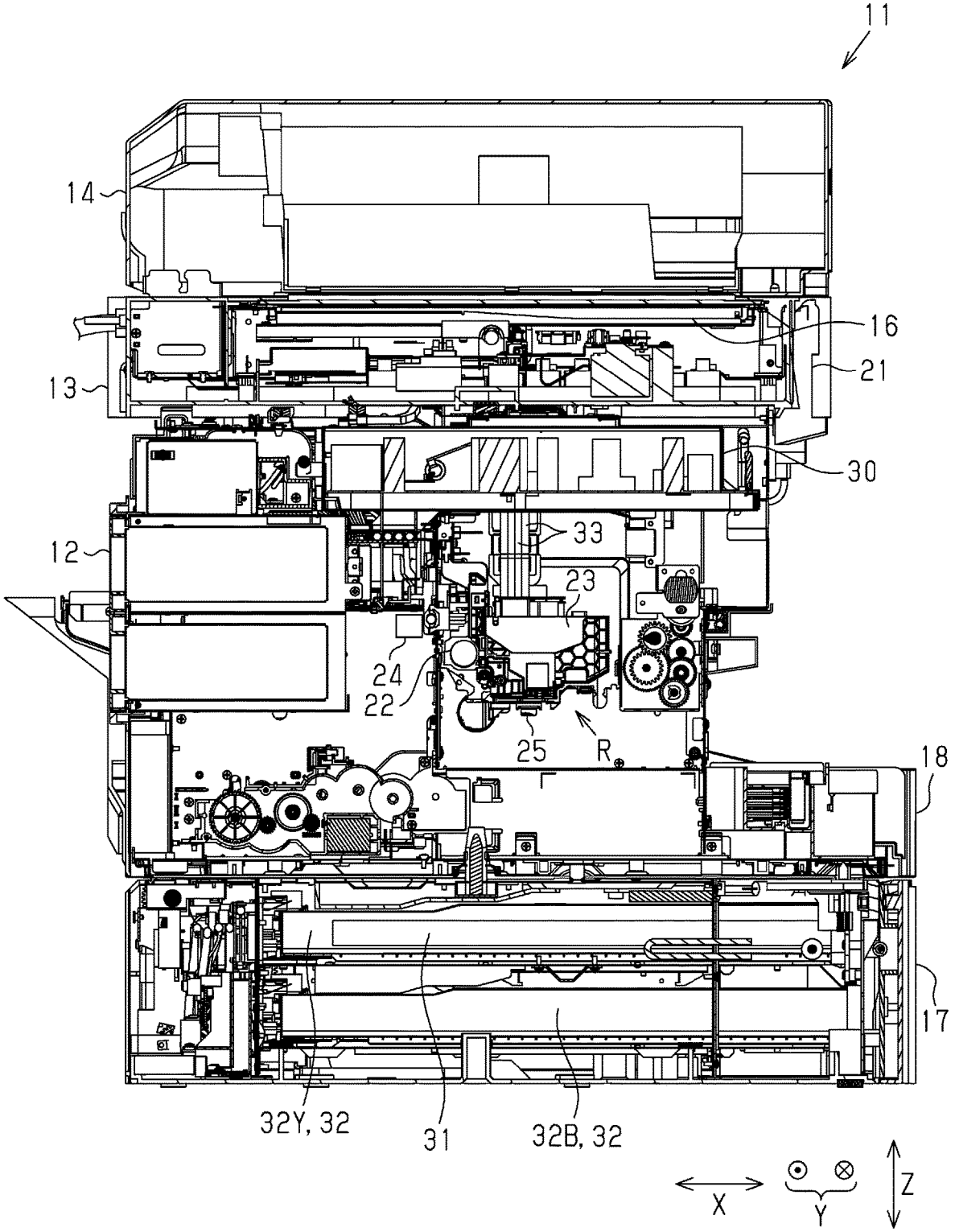
FIG. 2 is a side view of FIG. 1.

As shown in FIGS. 1 and 2, a guide shaft 22 extending in the width direction Y is provided above a paper cassette 18 in the casing 12. On the guide shaft 22, a carriage 23 is supported to be capable of reciprocating in a width direction Y which is one direction. Driven by a carriage motor 24 as a driving source, the carriage 23 reciprocates along the guide shaft 22. A recording head 25 that ejects ink as an example of a liquid is supported below the carriage 23.

Then, recording is performed on the paper sheet P by the ejection of ink toward the paper sheet P from the recording head 25 that reciprocates together with the carriage 23 in the width direction Y while the paper sheet P supplied from the paper cassette 18 to the region facing the recording head 25 is transported by the transport section (not shown) in the discharge direction. The paper sheet P (recorded paper sheet P) recorded by the recording head 25 is discharged from the discharge port 20.

Figure 3:
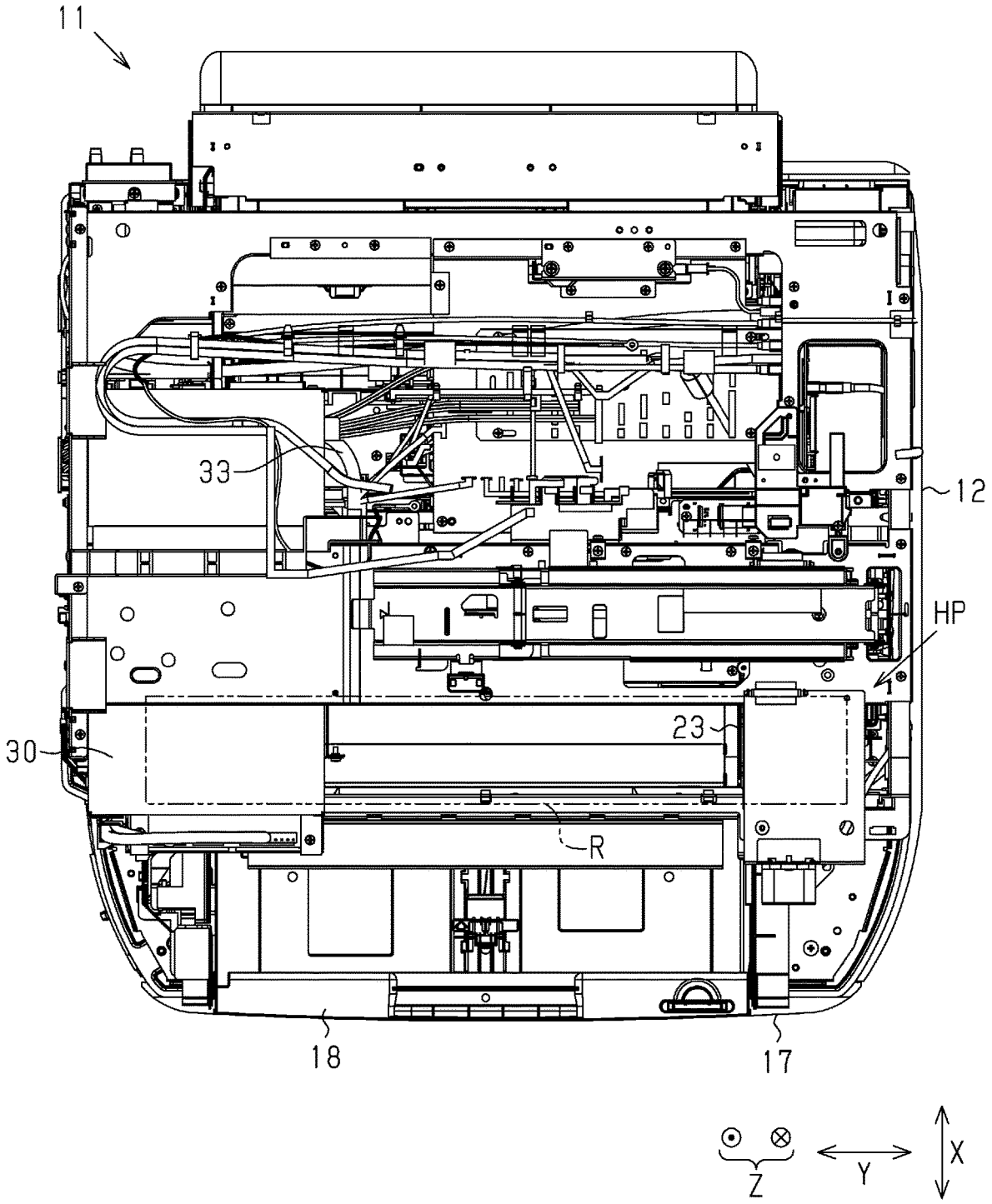
FIG. 3 is a plan view showing an inside of a casing of the ink jet type printer.

As shown in FIGS. 1 and 3, a one end portion (right end portion in FIGS. 1 and 3) in the moving region R of the carriage 23 is a standby position (home position) HP where the carriage 23 stands by. A rectangular parallelepiped power supply unit 30 is disposed above the moving region R of the carriage 23 in the casing 12. The power supply unit 30 supplies electricity to a variety of driving targets of the ink jet type printer 11 including the carriage motor 24 (refer to FIG. 2) and the recording head 25.

The power supply unit 30 is disposed such that at least a part thereof overlaps with the moving region R on an upper side. In accordance with the embodiment, the power supply unit 30 is disposed at a position (corresponding position) where a part of the power supply unit 30 overlaps with an end portion on an opposite side from the standby position HP side in the moving region R in the vertical direction Z. That is, in accordance with the embodiment, the power supply unit 30 is disposed at a position where the power supply unit 30 does not overlap with the standby position HP of the carriage 23 at all in the vertical direction Z. In this case, the power supply unit 30 is disposed at a position roughly directly below the image reading section 16. That is, the image reading section 16 is disposed above the power supply unit 30.

Figure 4:
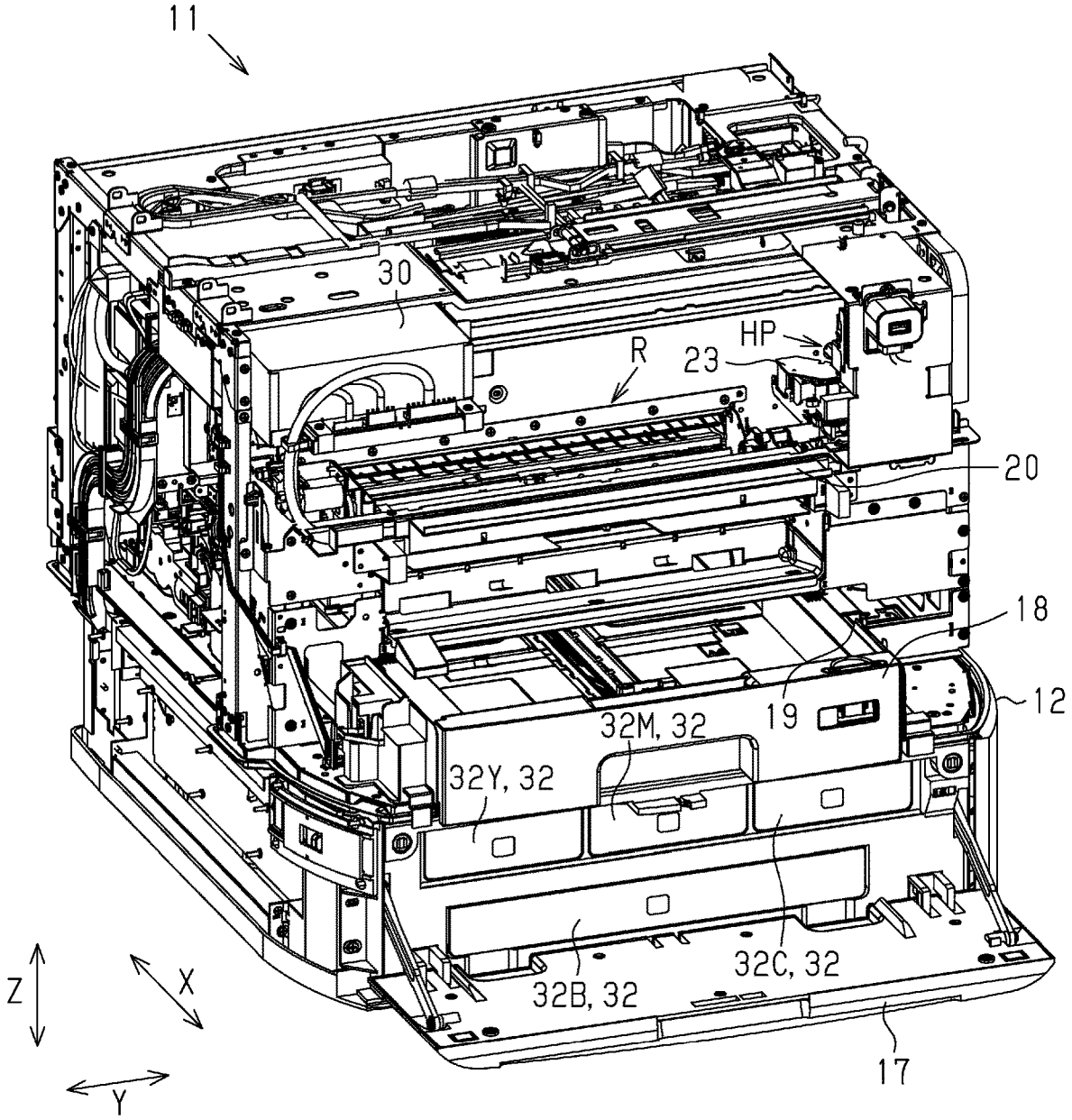
FIG. 4 is a perspective view showing the inside of the casing from a front side.

As shown in FIGS. 2 and 4, the opening/closing cover 17 is opened and closed when the ink accommodation body 32 that accommodates a flexible bag-shaped ink pack 31 filled with ink is attached to and detached from the casing 12. In accordance with the embodiment, four ink accommodation bodies 32 accommodating color inks different from one another are attached to and detached from the casing 12 respectively.

The four ink accommodation bodies 32 are configured with an ink accommodation body 32B in which blank ink is accommodated, an ink accommodation body 32C in which cyan ink is accommodated, an ink accommodation body 32M in which magenta ink is accommodated, and an ink accommodation body 32Y in which yellow ink is accommodated. Since the black ink is used more frequently than any other ink, the ink accommodation body 32B is configured to be bigger than ink accommodation bodies 32C, 32M and 32Y. The ink accommodation bodies 32C, 32M, and 32Y are of the same size.

Figure 5:
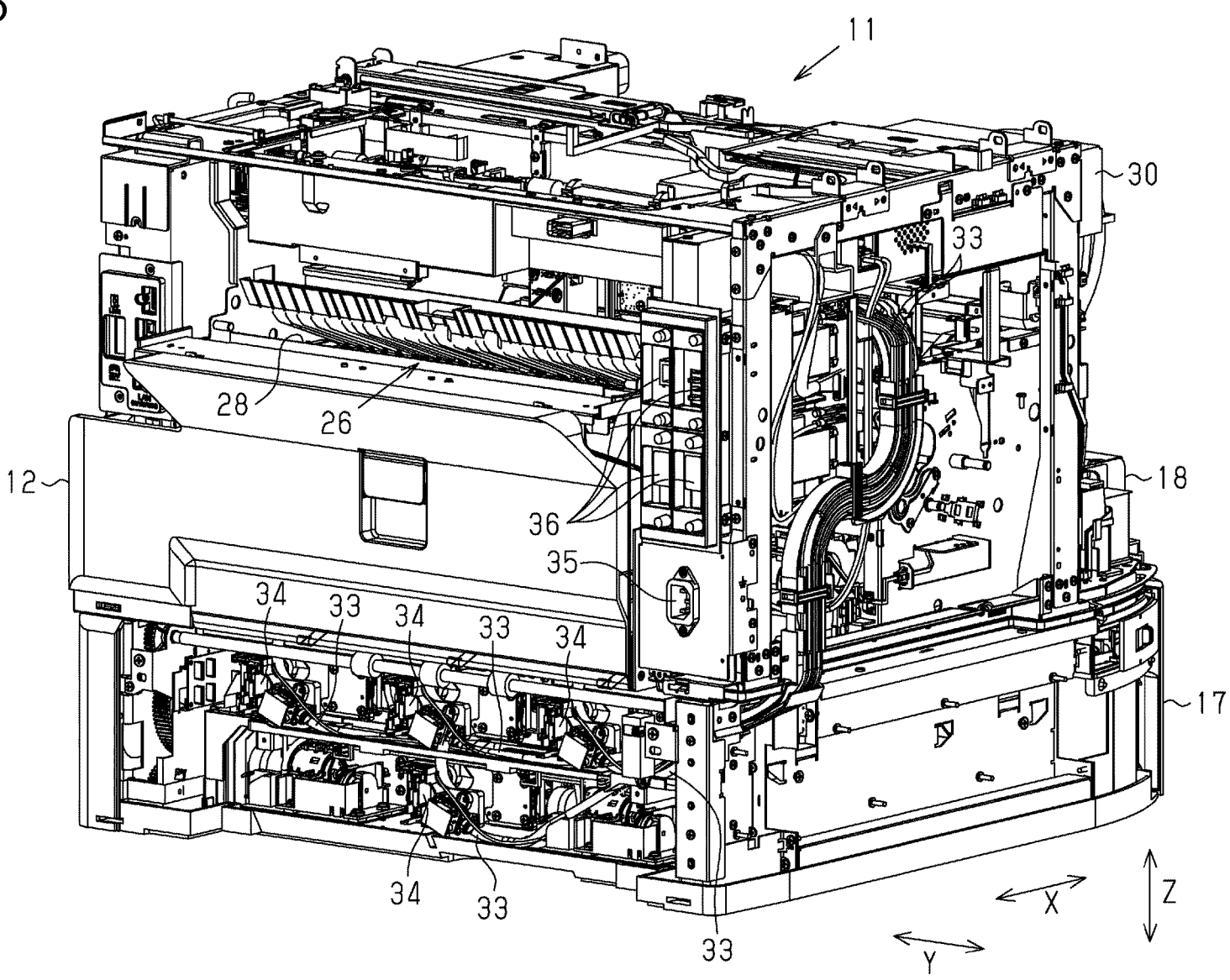
FIG. 5 is a perspective view showing the inside of the casing from a rear side.
Figure 6:
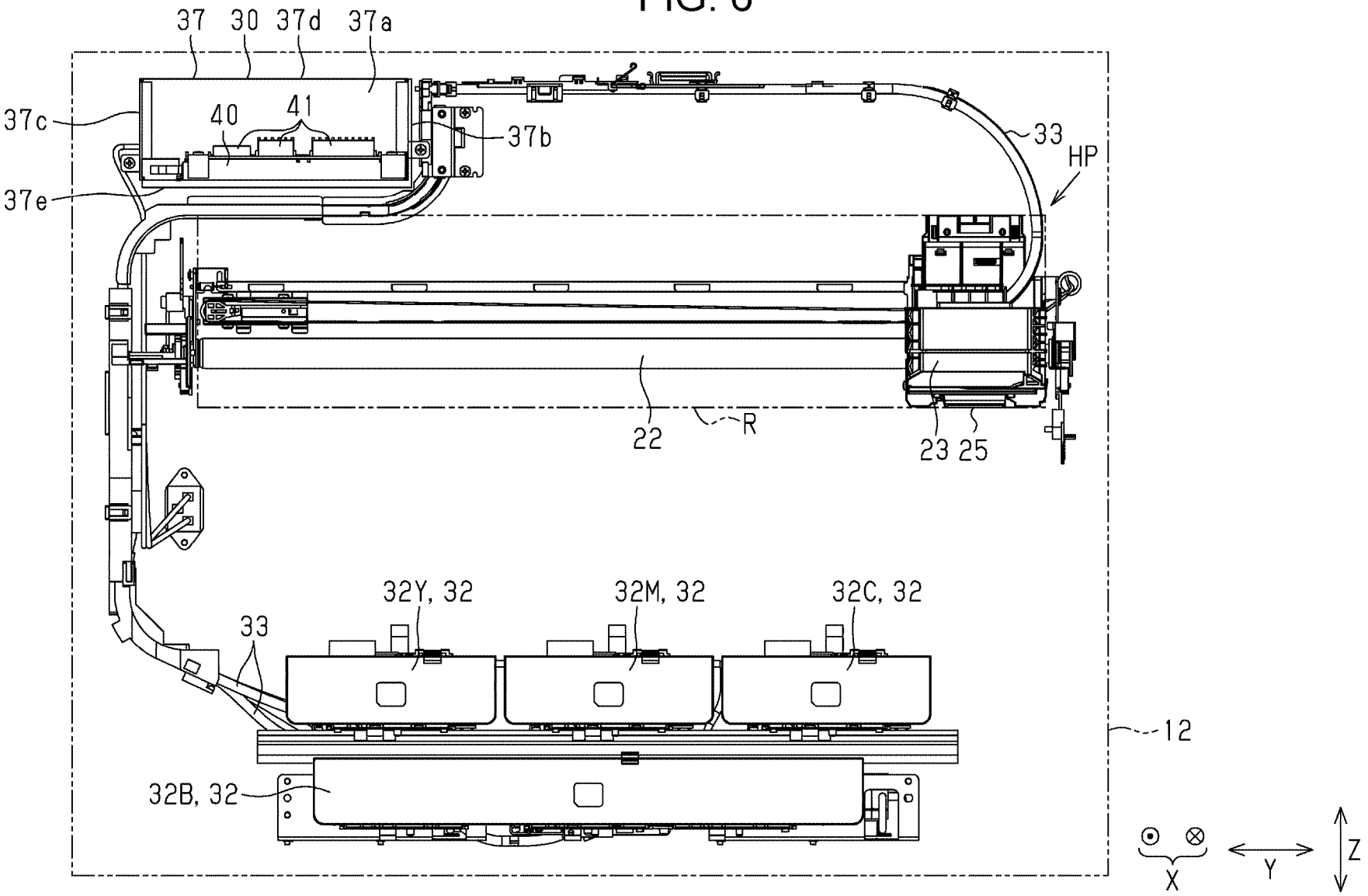
FIG. 6 is a front view showing a wiring state of a tube in the casing.

As shown in FIGS. 5 and 6, at a lower portion at the rear portion of the casing 12, four pumps 34 that pump up the inks accommodated in the four ink accommodation bodies 32 mounted to the casing 12 from below the moving region R to the recording head 25 and four flexible tubes 33 constituting liquid supply paths are disposed. One end side of the tube 33 is connected to each ink accommodation body 32, and the other end side is connected to the recording head 25. The tube 33 does not directly connect the ink accommodation body 32 and the recording head 25 but connects through other members.

A connection section 35 to which an AC power supply cord (not shown) is connected is provided at an end portion on the opposite side from the standby position HP of the carriage 23 in the width direction Y on an upper side of each pump 34 on the rear surface of the casing 12. A plurality of interfaces 36 for connecting a variety of types of hardware (not shown) are provided on the upper side of the connection section 35 on the rear surface of the casing 12. The connection section 35 and the interface 36 are disposed at positions lower than the power supply unit 30.

Each tube 33 extending from the lower portion at the rear portion of the casing 12 extends upward through the side portion on the opposite side from the standby position HP of the carriage 23 in the width direction Y, passes below the power supply unit 30, winds around a side portion of the standby position HP of the carriage 23 in the power supply unit 30, and then extends to a height position of an upper end of the power supply unit 30 (upper surface 37*d* of case 37 to be described later) in the casing 12. Subsequently, each of tube 33 that has passed the height position of the upper end of the power supply unit 30 extends straight horizontally to a side portion of the standby position HP of the carriage 23 in the width direction Y in the casing 12, and then curves downward to be connected to the recording head 25 supported by the carriage 23.

Figure 7:
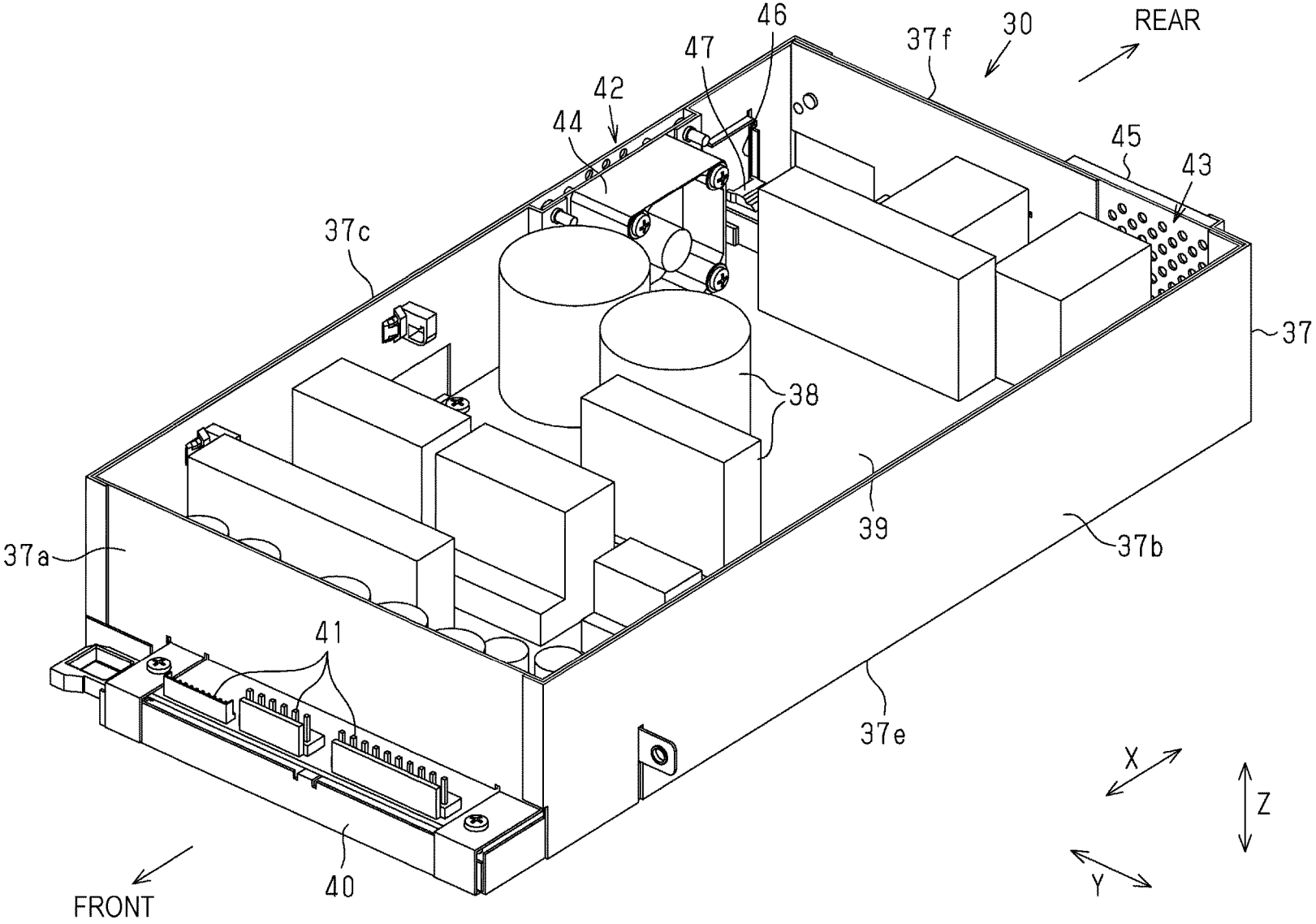
FIG. 7 is a sectional perspective view showing a power supply unit seen from the front side.
Figure 8:
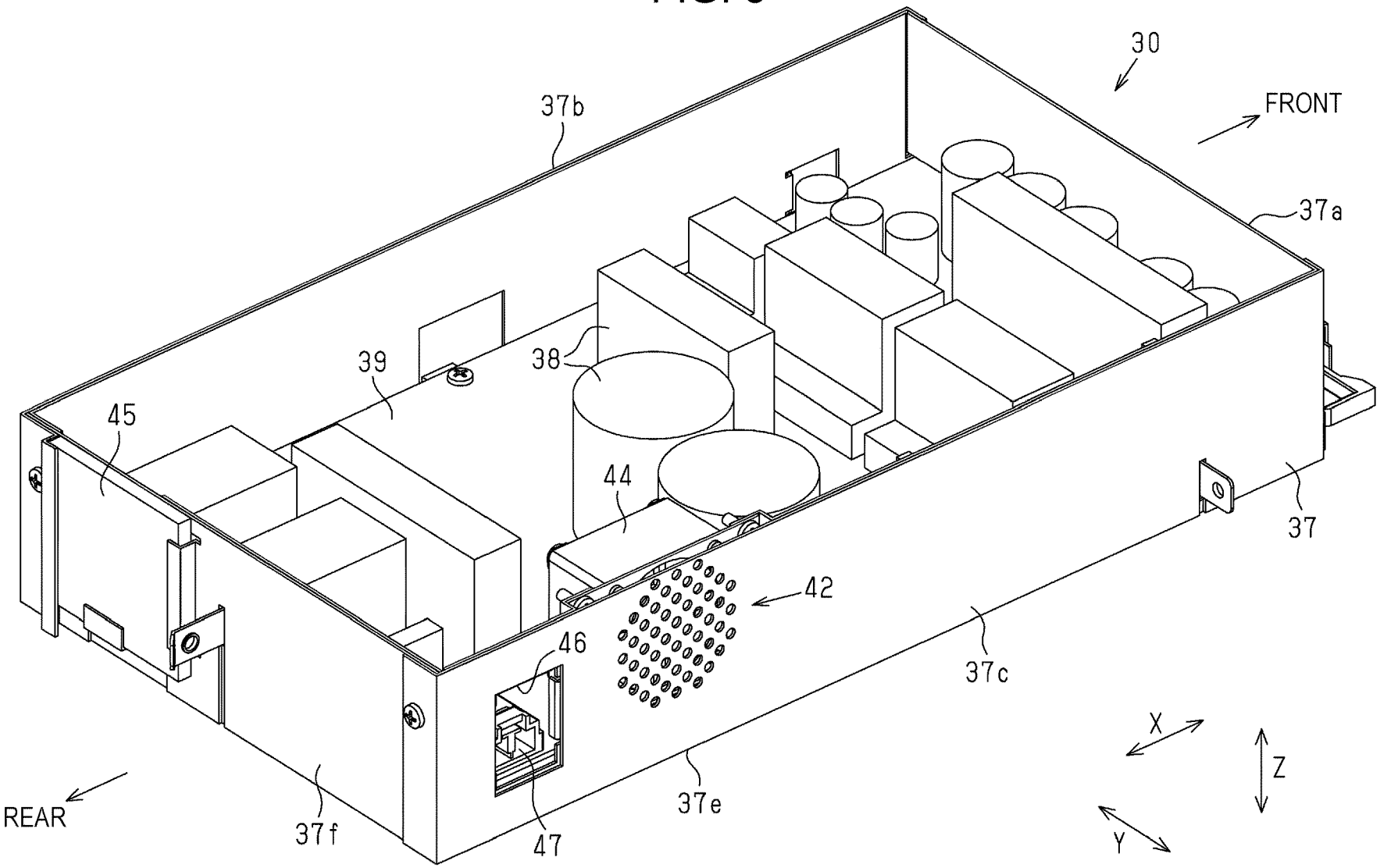
FIG. 8 is a sectional perspective view showing the power supply unit seen from the rear side.

As shown in FIGS. 6, 7, and 8, the power supply unit 30 includes a rectangular parallelepiped case 37 and a substrate 39 mounted with a variety of electronic components 38 accommodated in the case 37. At a lower portion of a front surface 37*a* of the case 37, a rectangular plate-shaped tongue piece section 40 is provided to protrude forward. On the tongue piece section 40, a plurality of first connectors 41 to which a variety of DC output harnesses (not shown) are connected are erected to line up in the width direction Y. In the case 37, a side surface on the center portion side of the moving region R of the carriage 23 in the width direction Y is a first side surface 37*b* and the side surface on the opposite side from the first side surface 37*b* is a second side surface 37*c*.

In order to suppress the penetration of the mist of ink ejected from the recording head 25 into the case 37, it is preferable that the power supply unit 30 be shielded from the outside air at least on the lower surface 37*e* and the first side surface 37*b* (region outside the power supply unit 30 in the casing 12) of the case 37. This is because the lower surface 37*e* and the first side surface 37*b* of the case 37 directly confront the moving region R of the carriage 23 so that the possibility that the mist of ink penetrates is relatively high. Therefore, in accordance with the embodiment, the power supply unit 30 is shielded from the outside air on the front surface 37*a*, the upper surface 37*d*, the lower surface 37*e* and the first side surface 37*b* of the case 37.

Further, in order to secure ventilation inside the case 37 while suppressing the penetration of the mist of ink ejected from the recording head 25 into the case 37, it is preferable that the power supply unit 30 be provided with an opening for communicating with the outside of the case 37 on a surface other than the lower surface 37*e* and the first side surface 37*b* of the case 37. This is because a surface other than the lower surface 37*e* and the first side surface 37*b* of the case 37 does not directly confront the moving region R of the carriage 23 so that the possibility that the mist of ink penetrates is relatively low. Therefore in accordance with the embodiment, the power supply unit 30 is provided with a first opening 42 and a second opening 43 respectively for communicating with the outside of the case 37 on the second side surface 37*c* and the rear surface 37*f* of the case 37. The first opening 42 and the second opening 43 are configured with a collection of a plurality of through holes.

A fan 44 that discharges the air inside the case 37 from the first opening 42 to the outside of the case 37 is disposed inside the first opening 42 of the case 37. For the fan 44, an axial flow fan is used, for example. A rectangular plate-shaped filter 45 is attachably/detachably disposed on the outer surface of the second opening 43 in the case 37. A filter 45 covers the second opening 43. For the filter 45, a non-woven fabric is used.

When the fan 44 is driven, the air inside the case 37 is discharged from the first opening 42 to the outside of the case 37. Then, the pressure inside the case 37 gets lower than the pressure outside the case 37, so that the air outside the case 37 is filtered through the filter 45 and drifts into the case 37 from the second opening 43 by the pressure difference inside/outside the case 37. As a result, the ventilation of the case 37 is carried out well and the temperature inside the case 37 goes down, so that the power supply unit 30 is cooled.

A rectangular third opening 46 is formed on the rear side of the first opening 42 on the second side surface 37*c* of the case 37. Inside the third opening 46 in the case 37, a second connector 47 to which an AC input cable (not shown) extending from the connection section 35 on the rear surface of the casing 12 to the case 37 is connected through the third opening 46 is disposed.

Next, the operation of the ink jet type printer 11 will be described.

When the recording onto the paper sheet P is performed by the ink jet type printer 11, ink is ejected from the recording head 25 that reciprocates together with the carriage 23 in the width direction Y onto the paper sheet P supplied from the paper cassette 18 to the region facing the recording head 25. As a result, recording is performed onto the paper sheet P, and the paper sheet P is discharged from the discharge port 20 at the time or recording. In this case, since the power supply unit 30 is disposed above the moving region R of the carriage 23 and the tube 33, even when the ink leaks from the carriage 23 and the recording head 25, the leaking ink does not penetrate inside the case 37 of the power supply unit 30.

Further, since the power supply unit 30 generates heat while the ink jet type printer 11 is used, the temperature of the air in the casing 12, the temperature around the power supply unit 30 in particular, gets higher than the temperature of the air in other regions. In this regard, in accordance with the embodiment, the air around the moving region R and the power supply unit 30 is stirred by the reciprocation of the carriage 23 in the width direction Y in the casing 12. Therefore, the temperature of the air around the power supply unit 30 goes down, so that the power supply unit 30 is cooled. That is, the power supply unit 30 is cooled by the stirring of the air caused by the reciprocation of the carriage 23.

According to the embodiment described above in detail, the following effect can be obtained.

(1) The power supply unit 30 is disposed such that at least a part thereof overlaps with the moving region R of the carriage 23 on the upper side. With this configuration, since the power supply unit 30 is disposed at a position higher than the carriage 23, if the ink leaks from the carriage 23, the penetration of the leaking ink into the power supply unit 30 can be suppressed. In addition, the reciprocation of the carriage 23 in the width direction Y can stir the air of relatively high temperature around the power supply unit 30 in the casing 12. Therefore, the temperature of the air around the power supply unit 30 can be lowered, so that the power supply unit 30 can be cooled.

(2) The tube 33 that supplies ink from below the moving region R of the carriage 23 to the recording head 25 passes below the power supply unit 30 and supplies ink to the recording head 25. With this configuration, if ink leaks from the tube 33, the penetration of the leaking ink into the case 37 of the power supply unit 30 can be suppressed.

(3) The tube 33 passes below the power supply unit 30 and passes the height position of the upper end of the power supply unit 30, and then curves downward to be connected to the carriage 23. With this configuration, the curvature of the tube 33 can be reduced. Therefore, the load on the tube 33 can be reduced, so that the life of the tube 33 can be extended. In addition, since the curvature of the tube 33 can be reduced, the load received by the tube 33 when the carriage 23 moves can be reduced.

(4) The power supply unit 30 is disposed at a position where the power supply unit 30 does not overlap with the standby position HP of the carriage 23 in the vertical direction Z. With this configuration, an adverse impact of the heat generated by the power supply unit 30 on the recording head 25 standing by at the standby position of the carriage 23 can be suppressed.

(5) The power supply unit 30 is disposed at a position where the power supply unit 30 confronts the end portion of the moving region R of the carriage 23 in the width direction Y, and at least the lower surface 37*e* and the first side surface 37*b* of the case 37 are shielded. With this configuration, since the lower surface 37*e* and the first side surface 37*b* of the case 37 susceptible to wind generated by the movement of the carriage 23 are shielded, the penetration of the mist of ink ejected from the recording head 25 into the case 37 of the power supply unit 30 can be suppressed effectively.

(6) The power supply unit 30 is provided with the first opening 42 and the second opening 43 that communicate with the outside of the case 37 respectively on the second side surface 37*c* and the rear surface 37*f* of the case 37. With this configuration, since the first opening 42 and the second opening 43 are respectively provided on the second side surface 37*c* and the rear surface 37*f* of the case 37 which hardly receives the wind generated by the movement of the carriage 23, ventilation can be secured inside the case 37 of the power supply unit 30, so that penetration of the mist of ink into the case 37 can be suppressed.

(7) The power supply unit 30 has the fan 44 that discharges the air in the case 37 from the first opening 42 to the outside of the case 37. With this configuration, the inside of the case 37 of the power supply unit 30 can be forced to cool by the driving of the fan 44.

Second Embodiment

Next, the ink jet type printer 11 in accordance with the second embodiment will be described with reference to FIGS. 9 to 23. In the embodiment, the cooling structure of the power supply unit 30 is different from the cooling structure of the first embodiment. Although a detailed description is skipped in the first embodiment, the ink jet type printer 11 includes a main substrate 61 that takes charge of controls of the driving target and the relay substrate 62 that serves as a relay between the driving target and the main substrate 61. Further, the ink jet type printer 11 also includes a slot 70 for adding an interface 36 and a hard disk drive 90. In addition to the cooling structure of the power supply unit 30, the present embodiment is also characterized by the connection structure of the main substrate 61 and the relay substrate 62, the configuration of the slot 70 for additional interfaces, and the disposition structure of the hard disk drive 90. Therefore, these characteristic configurations will be described.

Figure 9:
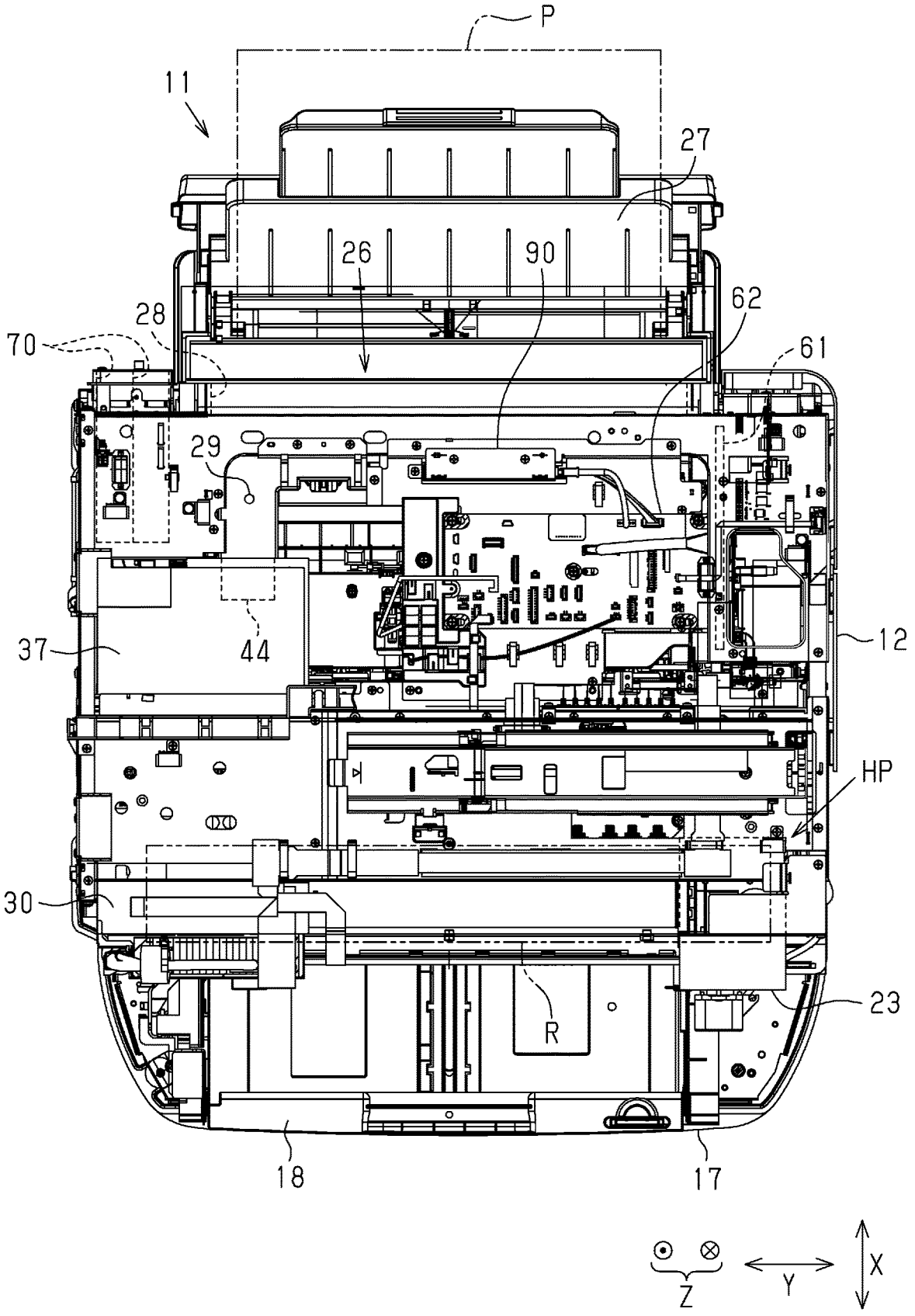
FIG. 9 is a plan view showing the inside of a casing of the ink jet type printer in accordance with a second embodiment.

As shown in FIG. 9, the rectangular parallelepiped power supply unit 30 is disposed at the same position as in the first embodiment in the casing 12. That is, the power supply unit 30 is disposed above the moving region R of the carriage 23 in the casing 12. The power supply unit 30 is disposed such that at least a part thereof overlaps with the moving region R on the upper side. The power supply unit 30 is disposed at a position where a part of the power supply unit 30 overlaps with the end portion on the opposite side of the moving region R from the standby position HP side in the vertical direction Z. That is, the power supply unit 30 is disposed at a position where the power supply unit 30 does not overlap at all with the standby position HP of the carriage 23 in the vertical direction Z. The power supply unit 30 supplies electricity to a variety of driving targets, including a carriage motor 24 (refer to FIG. 2) and the recording head 25. In accordance with the embodiment, the power supply unit 30 includes the fan 44 on the rear surface of the case 37.

As shown in FIGS. 5 and 9, the ink jet type printer 11 has a supply section 26 that supplies the paper sheet P at the rear portion of the apparatus. The supply section 26 is provided at the rear portion of the casing 12 and supplies the paper sheet P set in a supply tray 27 (refer to FIG. 9) into the casing 12. The supply tray 27 is a telescope type provided at the rear portion of the casing 12, is manually slidable by a user, and is pulled out rearward for use. The supply section 26 has a supply port 28 (also refer to FIG. 5) that serves as an inlet of a transport path through which the paper sheet P set in the supply tray 27 is fed into the casing 12. The supply port 28 is open at the rear portion of the casing 12. The supply section 26 has a feeding motor (not shown) and a feed roller, which are driving sources thereof. The supply section 26 feeds the paper sheet P set in the supply tray 27 from the supply port 28 into the casing 12 by a feed roller that is driven to rotate by the feed motor. Further, the feed path of the paper sheet P supplied from the paper cassette 18 shown in FIG. 5 by the second supply section (not shown) merges with the transport path for which the supply port 28 serves as an inlet in the casing 12. There, the paper sheet P fed from either the supply tray 27 or the paper cassette 18 is also transported through the transport path that passes below the moving region R of the carriage 23.

The rear portion of the casing 12 is a portion that easily takes in the outside air into the casing 12, like the supply port 28 that enables the communication of the inside of the casing 12 with the outside. In the present example, the supply port 28 open at the rear portion of the casing 12 is used as an intake port of outside air when the power supply unit 30 shown in FIG. 9 is cooled by the fan 44.

As shown in FIG. 9, the main substrate 61 that controls a variety of driving targets including the carriage motor 24 and the recording head 25 (refer to FIG. 2 for either) and a relay substrate 62 that serves as a relay between the main substrate 61 and the driving targets are provided in the casing 12. The relay substrate 62 is electrically connected to the main substrate 61 and controls all or a part of a plurality of driving targets in accordance with an instruction from the main substrate 61.

In addition, as shown in FIG. 9, a hard disk drive 90 is disposed in the casing 12. The hard disk drive 90 stores a variety of setting data and a variety of data that the main substrate 61 receives through a communication port (not shown) and the interface 36.

As shown in FIG. 9, the main substrate 61, the relay substrate 62 and the hard disk drive 90 are disposed above the moving region R of the carriage 23 in the casing 12 in the same way as the power supply unit 30. Further, in an example shown in FIG. 9, the main substrate 61, the relay substrate 62, and the hard disk drive 90 are positioned behind the moving region R of the carriage 23 in the casing 12. Further, the main substrate 61 and the relay substrate 62 are disposed at positions close to the standby position HP, which is an opposite side to the disposition position of the power supply unit 30 in the width direction Y. In addition, the hard disk drive 90 is disposed behind the disposition positions of the power supply unit 30, the main substrate 61 and the relay substrate 62.

Hereinafter, the cooling structure of the power supply unit 30, the connection structure of the main substrate 61 and the relay substrate 62, the partition plate structure of the slot 70, the grounding structure of the slot 70 and the disposition structure of the hard disk drive 90 will be described one by one.

First, the cooling structure of the power supply unit 30 will be described with reference to FIGS. 9 to 11. The depth direction X is also the transport direction of the paper sheet P supplied from the supply port 28, and, therefore, is also referred to as "transport direction X".

As shown in FIG. 9, the power supply unit 30 is disposed at a position on the downstream side of the supply section 26 including the supply port 28 in the transport direction X and at a height position above the supply section 26 in the vertical direction Z. The fan 44 that generates an airflow for cooling the power supply unit 30 in the case 37 is positioned on the side of the supply section 26 from the power supply unit 30. In addition, a flow path 29 that serves as a space in which the air taken in through the supply port 28 drifts is provided in the rear region of the fan 44. In accordance with the embodiment, the fan 44 sucks in the air from the supply section 26. The air that the fan 44 sucks in from the supply section 26 drifts through the flow path 29 and is supplied from the fan 44 into the power supply unit 30.

In accordance with the embodiment, the power supply unit 30 includes the rectangular parallelepiped case 37 like in the first embodiment and a power supply substrate 54 accommodated in the case 37. As shown in FIG. 10, the power supply substrate 54 includes a substrate 39 accommodated in the case 37 and a variety of electronic components 38 mounted on the substrate 39. A plurality of first connectors 41 to which a variety of DC output harnesses (not shown) are connected are erected side by side in the width direction Y on a rectangular plate-shaped tongue piece section 40 protruding forward from the lower portion of the front surface 37*a* of the case 37. In the case 37, a side surface on the center portion side of the moving region R of the carriage 23 in the width direction Y is a first side surface 37*b* and the side surface on the opposite side of the first side surface 37*b* is a second side surface 37*c*.

Like in the first embodiment, in order to secure an airflow in the case 37 while suppressing the penetration of the mist of ink ejected from the recording head 25 in the case 37, the power supply unit 30 has an opening for communicating with the outside of the case 37 on a surface other than the lower surface 37*e* and the first side surface 37*b* of the case 37. In an example in FIGS. 10 and 11, in the same way as in the first embodiment, the power supply unit 30 includes the first opening 42 and the second opening 43 that communicate with the outside of the case 37 respectively on the second side surface 37*c* and the rear surface 37*f* of the case 37. Since the second side surface 37*c* and the rear surface 37*f* in the case 37 directly do not confront the moving region R of the carriage 23, even if the openings 42 and 43 are provided, the possibility of the mist of ink penetrating is relatively low.

Figure 10:
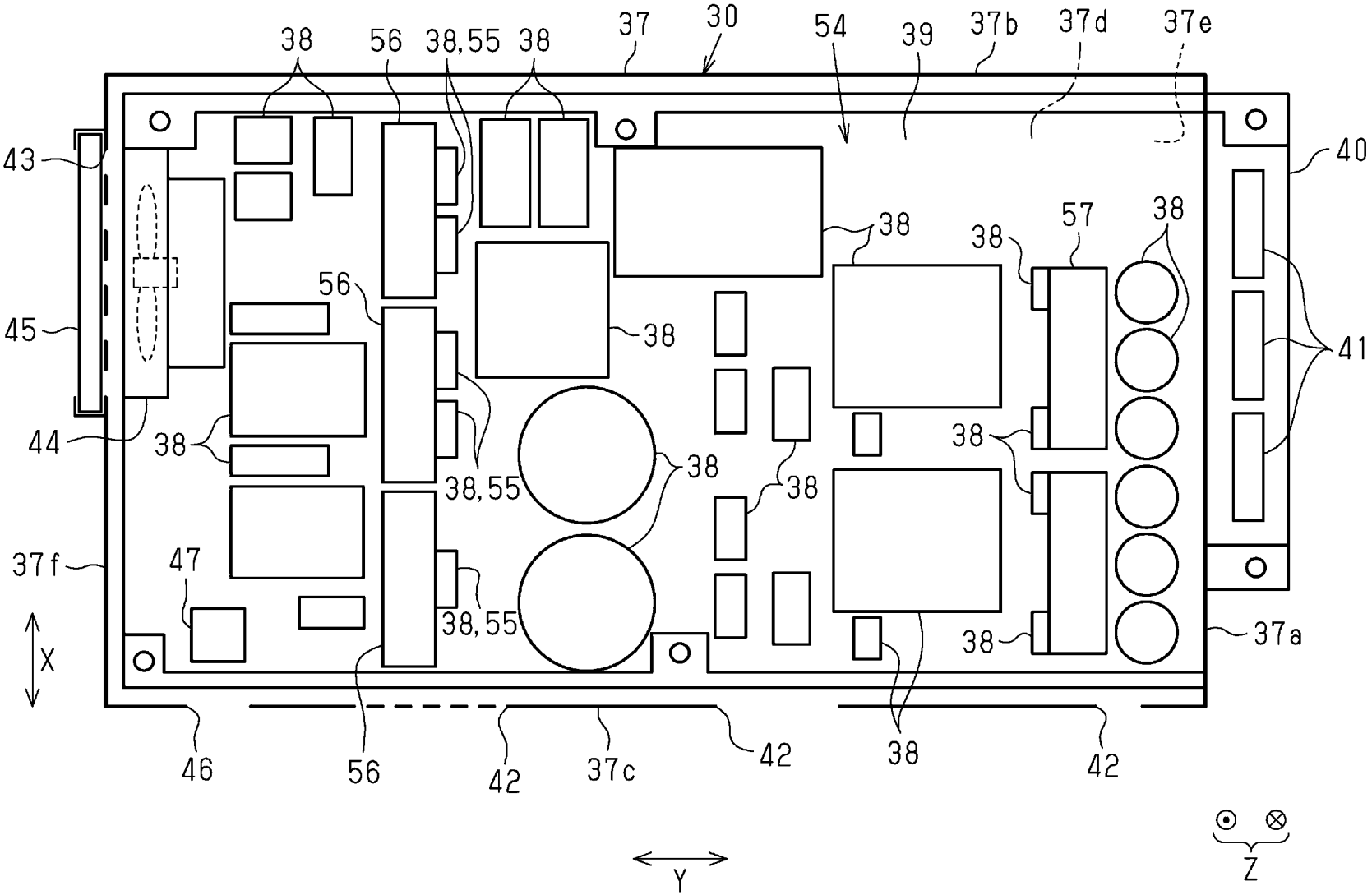
FIG. 10 is a plan view with an upper surface of the power supply unit removed.

As shown in FIG. 10, the power supply unit 30 has the fan 44 that sucks in the outside air from the second opening 43, which is an example of an opening. The second opening 43 is disposed on the supply section 26 side of the power supply unit 30. The fan 44 sucks in the air from the supply section 26. The fan 44 is disposed on the rear surface 37*f* of the case 37 of the power supply unit 30 and sucks in the air outside the case 37 through the second opening 43 into the case 37. Specifically, the fan 44 is disposed at a position where the fan 44 faces the second opening 43 on the rear surface 37*f* of the case 37 in a direction in which the air is fed from the outside toward the inside of the case 37. As for the fan 44, an axial flow fan is used, for example. Since the outside air is sucked in from the second opening 43 to the power supply unit 30 by the driving of the fan 44, the inside of the power supply unit 30 can be cooled effectively. In addition, as shown in FIG. 10, the filter 45 is provided outside the second opening 43. While the fan 44 is driven, the air filtered by the filter 45 is sucked into the case 37.

Figure 11:
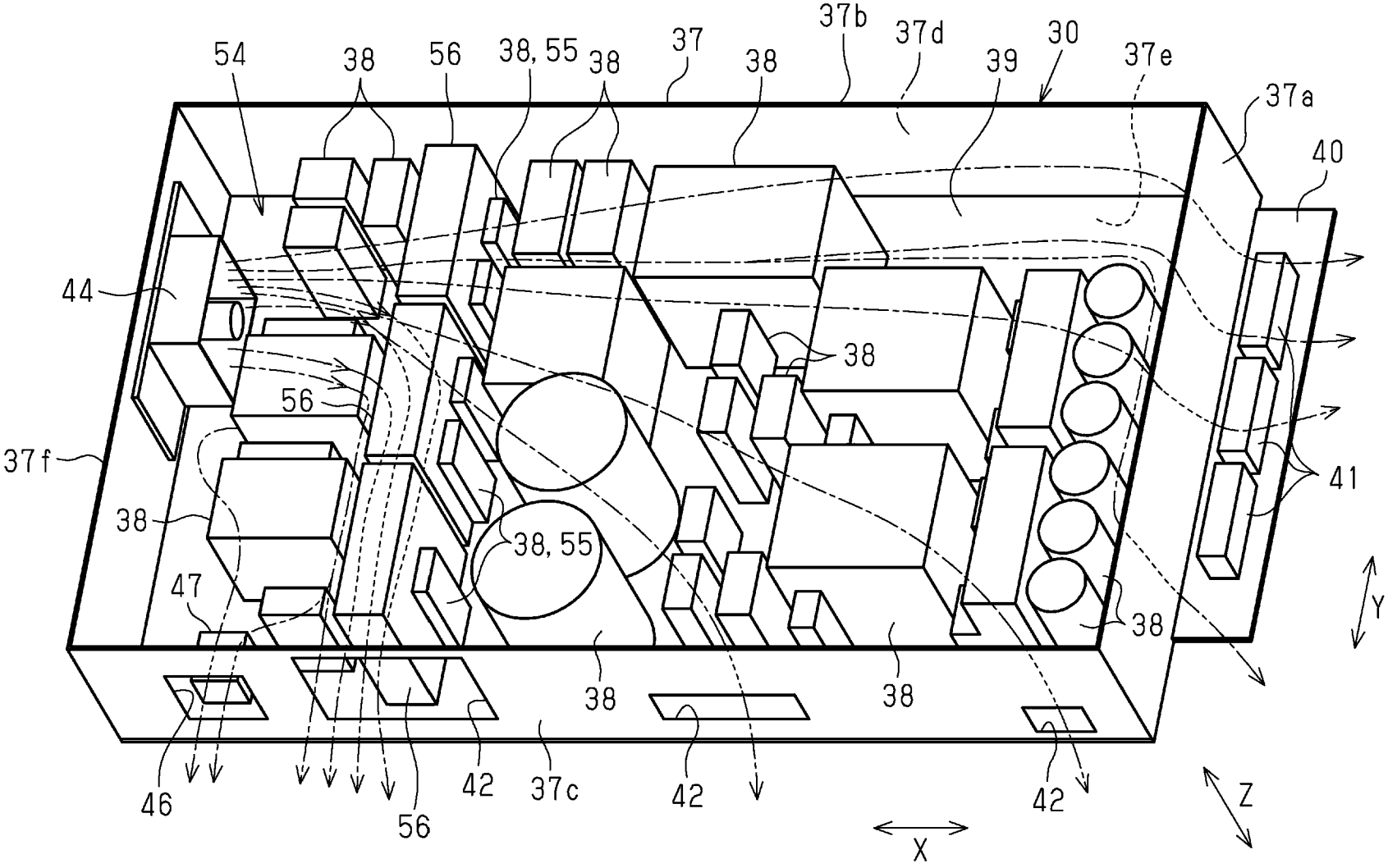
FIG. 11 is a perspective view showing an airflow drifting through the power supply unit when a fan is driven.

In the examples shown in FIGS. 10 and 11, in the power supply unit 30, the fan 44 disposed on the rear surface 37*f* of the case 37 sucks in the air from the second opening 43 into the case 37 and discharges the air inside the case 37 from the first opening 42 that is open on the second side surface 37*c* of the case 37. That is, in the embodiment, the second opening 43 serves as an air intake port for suction and the first opening 42 serves as an air discharge port. The first opening 42 is configured with a collection of a plurality of through holes or is covered with a cover having a plurality of through holes. In addition, an opening (not shown) for air discharge which is a gap or a hole is provided at the lower portion of the front surface 37*a* of the case 37. In addition, when an airflow is generated in a desired path in the case 37, an opening for air discharge which is a gap or a hole may be provided on the first side surface 37*b*.

As shown in FIGS. 10 and 11, the power supply unit 30 accommodates a power supply substrate 54 mounted with a converter 55 which is a heat generating component inside and a heat sink 56 which is in contact with the converter 55. That is, in the electronic component 38 mounted on the substrate 39, a plurality of converters 55 are included, and each converter 55 is mounted in contact with one side surface of the heat sink 56 disposed on the substrate 39. The heat sink 56 is disposed along the rear surface 37*f*, which is the surface on which the fan 44 is disposed in the power supply unit 30. The heat sink 56 has a square plate shape and is made of a metal having a high thermal conductivity such as aluminum. The heat sink 56 has a plurality of fins and a plurality of recessed grooves on the first surface opposite to the rear surface 37*f* on which the fan 44 is disposed. A plurality of fins and a plurality of recessed grooves extend horizontally on the first surface of the heat sink 56.

In the examples shown in FIGS. 10 and 11, three heat sinks 56 are provided. The three heat sinks 56 are disposed along the rear surface 37*f* on which the fan 44 is disposed. That is, the three heat sinks 56 are disposed such that the lengthwise direction thereof is the width direction Y. The three heat sinks 56 are disposed such that the lengthwise direction thereof is parallel to the rear surface 37*f* on which the fan 44 is disposed. One or two of the plurality of heat sinks 56 are disposed (in the direction?) such that the first surface on which the fins and the recessed grooves are formed faces the fan 44. The converter 55 is in contact with the second surface, which is a surface opposite to the first surface of the heat sink 56.

Further, as shown in FIGS. 10 and 11, another heat sink 57 is disposed at a position close to the front in the case 37. The heat sink 57 is disposed such that the lengthwise direction thereof intersects with the air blowing direction of the fan 44. The plurality of heat sinks 57 are disposed side by side in the width direction Y. In the heat sink 57, the electronic component 38 is in contact with the first surface, which is the surface facing the fan 44. The electronic component 38 that is in contact with the heat sink 57 does not generate heat as much as the converter 55 but is one heat generating component. An AC input cable (not shown) extending from the connection section 35 to the case 37 through the third opening 46 that is open on the second side surface 37*c* is connected to the second connector 47 in the case 37.

When the fan 44 is driven, the outside air is sucked into the case 37 from the second opening 43. Then, since the pressure inside the case 37 gets higher than the outside pressure, the air inside the case 37 drifts out to the outside from the first opening 42 due to the pressure difference between the inside/outside of the case 37. In this way, by the cold air sucked into the case 37 from the outside through the second opening 43 by the fan 44, an airflow denoted by a dotted chain line in FIG. 11 drifts along a predetermined flow path in the case 37 and is discharged from the first opening 42.

A part of the airflow taken into the power supply unit 30 by the fan 44 hits the first surface which is the rear surface of the heat sink 56, drifts along the fins and the recessed grooves of the first surface in the width direction Y, and is discharged from the first opening 42. At this time, the airflow of the cold air taken in from the outside by the fan 44 drifts along the first surface of each of the plurality of heat sinks 56. Therefore, the converter 55, which is a heat generating component, is cooled effectively in contact with the second surface of the heat sink 56.

Further, the other part of the air taken into the power supply unit 30 passes above the heat sinks 56 and through the gap between the heat sink 56 and drifts downstream (forward) of the transport direction X. The airflow drifting ahead of the heat sink 56 cools other electronic components 38 including the electronic components 38 which are in contact with the heat sink 57 mounted on the front side of the substrate 39 and is discharged from the opening made of a gap or through holes that are open on the front surface 37*a* of the case 37. Therefore, the power supply unit 30 is cooled effectively.

In the first embodiment, the fan 44 is configured to discharge the air in the power supply unit 30 to the outside, so that heated air in the power supply unit 30 is discharged to the outside. Therefore, air is taken into the power supply unit 30 at a relatively low rate of flow in accordance with the inside/outside pressure difference, so that it is difficult to actively cool the heat generating components such as the converter in the power supply unit 30. On the other hand, in the second embodiment, the fan 44 is configured to suck the outside air into the power supply unit 30, so that the converter 55 which is a heat generating component can be aggressively cooled by the airflow of cold air.

Figure 12:
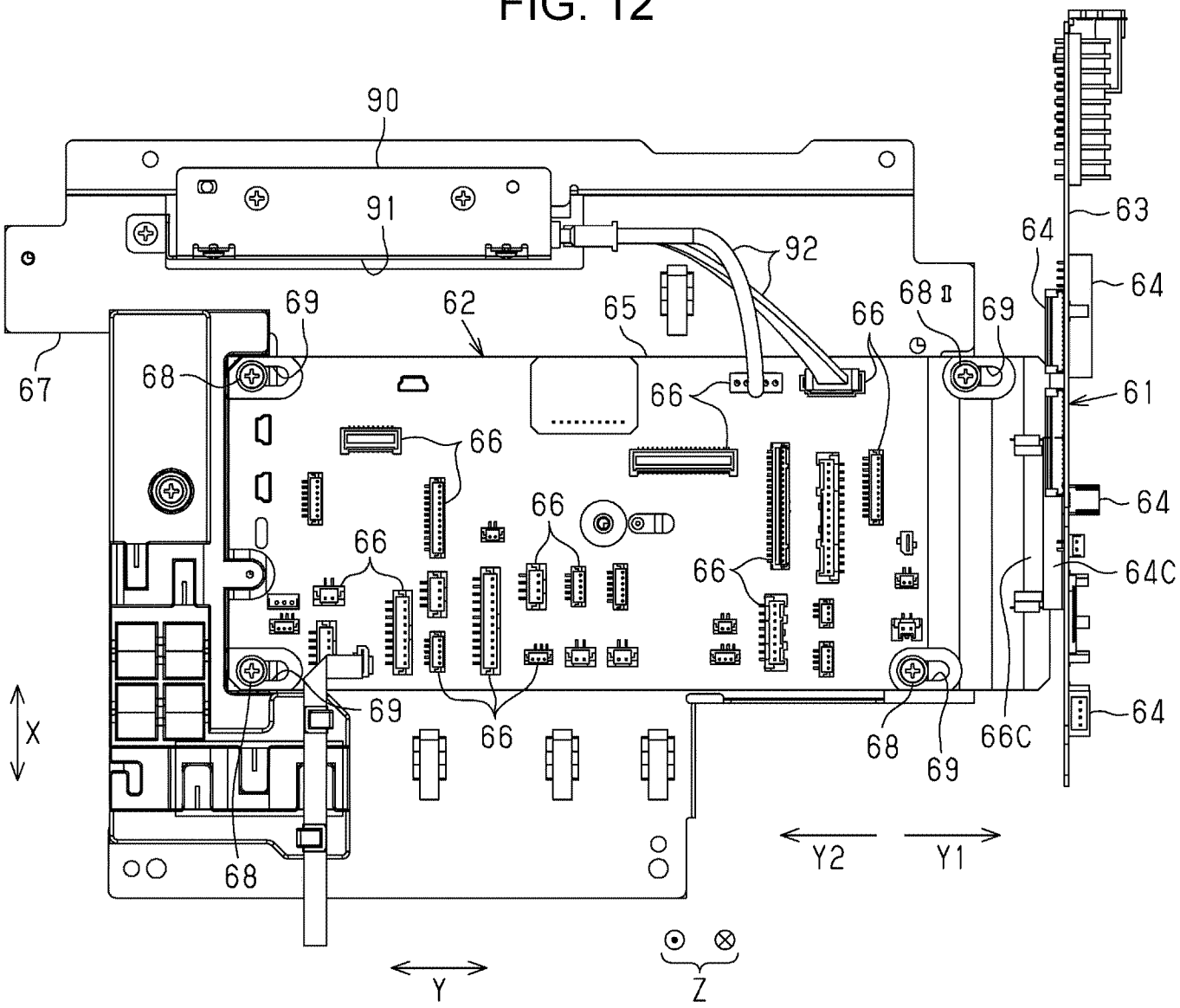
FIG. 12 is a plan view showing an integration structure of a main substrate and a relay substrate.
Figure 13:
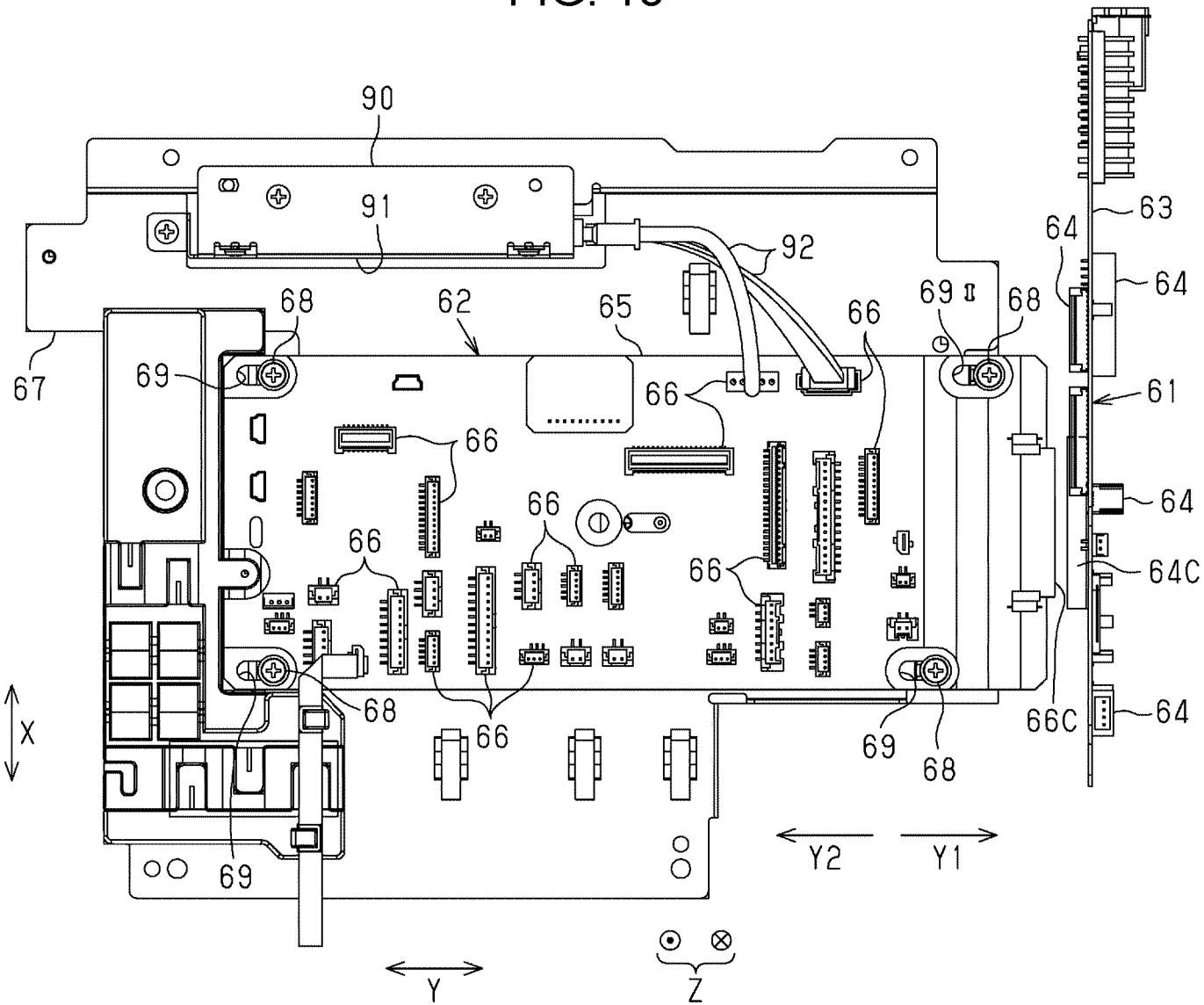
FIG. 13 is a plan view when the integration of the main substrate and the relay substrate is released.

Next, the connection structure between the main substrate 61 and the relay substrate 62 will be described with reference to FIGS. 9, 12, and 13. As shown in FIGS. 9 and 12, in the casing 12, the main substrate 61 is disposed at a position on one side of the width direction Y in such a direction that the substrate surface thereof intersects with the width direction Y. A central processing unit (CPU), an ASIC, or the like is mounted on the main substrate 61, and the CPU or the like on the main substrate 61 executes programs so as to take charge of a variety of controls including a print control.

Further, the relay substrate 62 that serves as a relay between the main substrate 61 and the driving targets is provided in the casing 12. The relay substrate 62 operates in accordance with the instructions from the CPU or the like mounted on the main substrate 61 so as to control the driving targets of the ink jet type printer 11. In the case of the present example in which the ink jet type printer 11 adopts a serial printing method, the recording head 25, the carriage motor 24, the feed motor, the transport motor, and the like are driving targets. In addition, in the embodiment, the hard disk drive 90 is also a driving target.

The relay substrate 62 is disposed at a position adjacent to the main substrate 61. The relay substrate 62 is disposed in such a direction that the substrate surface thereof intersects with the vertical direction Z. In contrast to the main substrate 61 being disposed longitudinally such that the substrate surface thereof is parallel to the vertical direction Z, the relay substrate 62 is disposed latitudinally such that the substrate surface thereof intersects with the vertical direction Z. The relay substrate 62 is disposed in a state to abut the main substrate 61 disposed longitudinally such that an upper end portion of the main substrate 61 and one side end portion of the relay substrate 62 intersect with each other. Therefore, the substrate surface of the main substrate 61 and the substrate surface of the relay substrate 62 are orthogonal to each other.

As shown in FIG. 12, the main substrate 61 includes a substrate 63 and a plurality of electronic components 64 mounted on the substrate 63. The electronic component 64 includes a CPU and an ASIC. Also, the relay substrate 62 includes a rectangular plate-shaped substrate 65 and a plurality of electronic components 66 mounted on the substrate 65. The electronic component 66 includes a connector component capable of connecting a wire by which the driving targets are electrically connected. In the example in FIG. 12, the connector, which is one of the electronic components 66 mounted on the relay substrate 62, is connected to the hard disk drive 90 by the wire 92.

The relay substrate 62 is assembled by a screwing of a plurality of screws 68 into the frame 67 provided in the casing 12. An elongated hole 69 into which the screw 68 can be inserted is formed on the substrate 65 that constitutes the relay substrate 62. In the example shown in FIG. 12, the relay substrate 62 is fixed with four screws 68 at the four corners. Therefore, four elongated holes 69 into which four screws 68 can be inserted are formed at the four corners of the substrate 65 such that the lengthwise direction thereof coincides with the width direction Y. Therefore, the relay substrate 62 can slide within the range of the elongated hole 69 in the lengthwise direction when the screw 68 is loosened. The lengthwise dimension of the elongated hole 69 is set at a value that enables the relay substrate 62 to move in the width direction Y with respect to the main substrate 61 to the extent of a stroke that enables the connection and the disconnection of the first connector 64C and the second connector 66C.

In an assembled state, on the main substrate 61, the first connector 64C is provided in the vicinity of a position where the side end portion of the relay substrate 62 faces the main substrate 61. Further, the second connector 66C capable of connecting with the first connector 64C is provided on the relay substrate 62 at a position where the second connector 66C confronts the first connector 64C of the main substrate 61. When the relay substrate 62 is slid along the elongated hole 69 in the first direction Y1 to approach the main substrate 61 in a state where the screw 68 is loosened, the second connector 66C and the first connector 64C are coupled. Further, when the relay substrate 62 is slid in the second direction Y2 which is an opposite direction to the first direction Y1 in a state where the screw 68 is loosened, the second connector 66C and the first connector 64C are uncoupled.

The second connector 66C is coupled with the first connector 64C of the main substrate 61 at the coupling position shown in FIG. 12 where the relay substrate 62 is slid in the first direction Y1. The first connector 64C and the second connector 66C are uncoupled at a retreat position shown in FIG. 13 where the relay substrate 62 is slid from the coupling position shown in FIG. 12 in the second direction Y2. In this state, the relay substrate 62 has retreated in the width direction Y to a position where the moving path along which the main substrate 61 moves when the main substrate 61 is removed upward in the vertical direction Z. That is, sliding the relay substrate 62 from the coupling position shown in FIG. 12 in the second direction Y2 to retreat the relay substrate 62 to the retreat position shown in FIG. 13 enables the main substrate 61 to be removed upward in the vertical direction Z.

In the embodiment, since the main substrate 61 and the relay substrate 62 are separated, when the relay substrate 62 fails, for example, the relay substrate 62 may be replaced and there is no need to replace the main substrate 61. Also, when there is a need to remove the main substrate 61 due to a failure or maintenance of the mounted components, the screws 68 of the relay substrate 62 are loosened, the relay substrate 62 is slid along the elongated hole 69 from the coupling position shown in FIG. 12 in the second direction Y2 to retreat to the retreat position shown in FIG. 13. As a result, as shown in FIG. 13, the relay substrate 62 retreats to a position where the removal path of the main substrate 61 is not interfered with, while the first connector 64C and the second connector 66C are uncoupled. Therefore, if the main substrate 61 is moved upwards along the removal path in the vertical direction Z, the main substrate 61 can be removed from the casing 12. At this time, the connector of wires by which other electronic components are connected is removed from the other connector of the main substrate 61 as deemed necessary.

In such an embodiment, when the main substrate 61 is removed, there is no need to remove the relay substrate 62. Further, there is no need to connect the connectors of both the main substrate 61 and the relay substrate 62 with a wire such as a flexible flat cable. When the main substrate 61 is attached at a predetermined assembly position of the casing 12 for the replacement or the assembly after maintenance, the relay substrate 62 is slid from the retreat position shown in FIG. 13 to the coupling position shown in FIG. 12, in the first direction Y1 after the main substrate 61 is inserted at the predetermined assembly position longitudinally and assembled. In this way, the first connector 64C and the second connector 66C are coupled, and then the screw 68 is tightened to fix the relay substrate 62.

Figure 14:
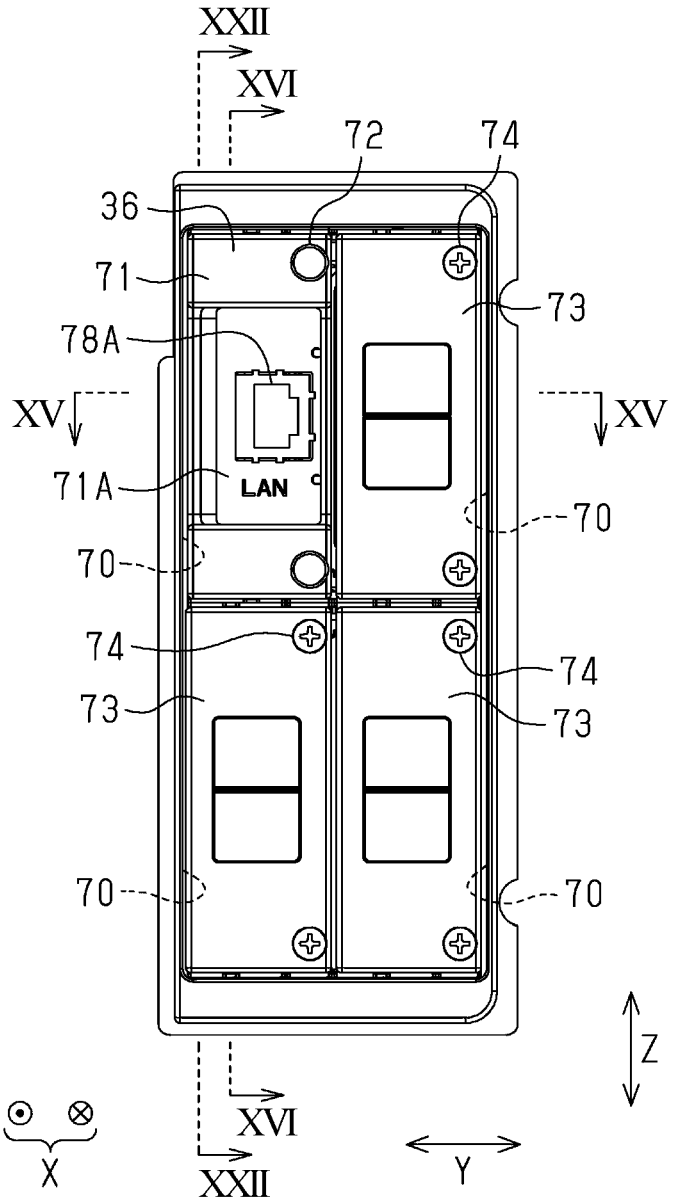
FIG. 14 is a rear view showing a slot or the like for an addition of an interface.
Figure 15:
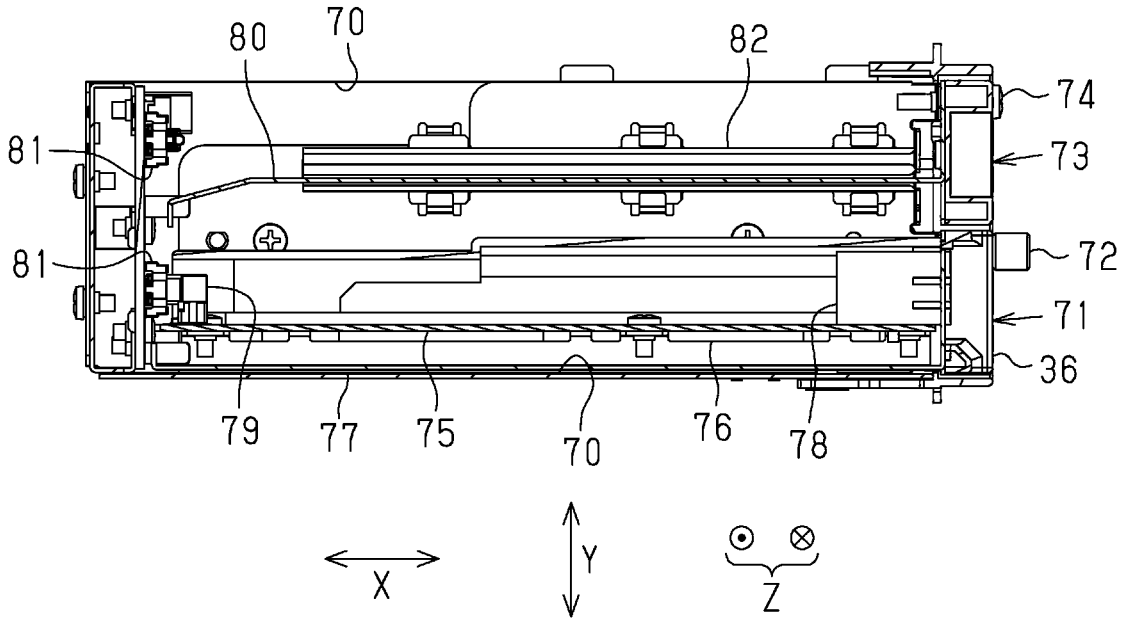
FIG. 15 is a sectional view taken along the line XV-XV in FIG. 14.
Figure 16:
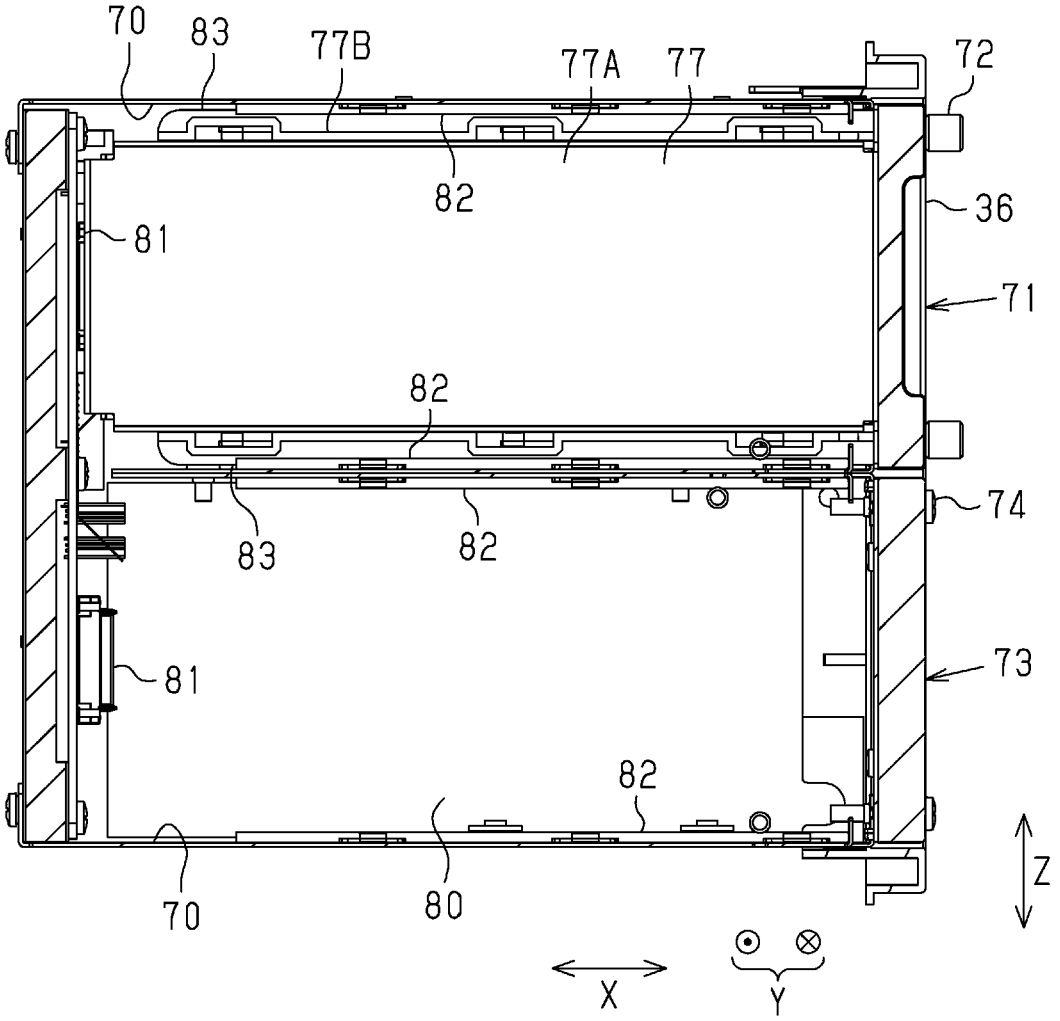
FIG. 16 is a sectional view taken along the line XVI-XVI in FIG. 14.

Next, the partition structure of the slot 70 will be described with reference to FIGS. 14 to 19. A plurality of interfaces 36 shown in FIG. 5 provided in the ink jet type printer 11 are added as deemed necessary. Therefore, as shown in FIGS. 14 to 16, the ink jet type printer 11 has a plurality of slots 70 for interface additions. In the example shown in FIG. 14, a total of four slots 70 in two rows and two columns are provided on the rear surface of the casing 12. The interface 36 is constituted by the additional interface unit 71 being inserted into the slot 70 and fixed with the screw 72 from the front side. The other slot 70 into which no additional interface unit is inserted is covered with the lid member 73. The lid member 73 is fixed with a plurality of screws 74. The slot 70 has a rectangular opening elongated in the vertical direction Z and has a length dimension in the depth direction X into which an additional interface unit 71 can be inserted. In the example shown in FIG. 14, the interface unit 71 is inserted into one of the four slots 70, so that one interface 36 is added.

In the embodiment, there are two types of slots 70. One is a slot for network communication and the other one is a slot for facsimile. In the example, there are two types of additional interface unit 71, namely a network communication unit 71A as shown in FIG. 14 and a facsimile unit (not shown). A corresponding additional interface unit 71 can be attachably/detachably inserted into the slot 70. Incidentally, the slots 70 may be one type that functions for both the network communication and the facsimile.

As shown in FIG. 14, the interface 36 is added by the insertion of the additional interface unit 71 into the slot 70 and the tightening of the screw 72 after the screw 74 is loosened and the lid member 73 is removed.

Figure 17:
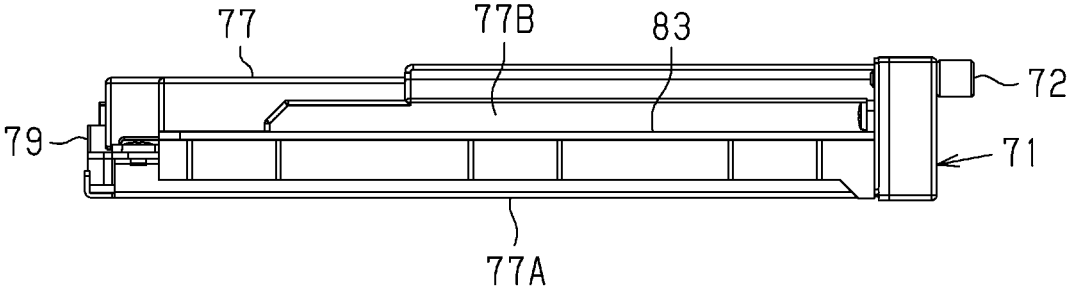
FIG. 17 is a side view of an interface unit.

As shown in FIG. 15, the additional interface unit 71 is a unit component that accommodates a substrate component 76 on which a plurality of components are mounted on a rectangular plate-shaped substrate 75 in the case 77. In the inserted state shown in FIG. 15, the interface component 78 is mounted on the end portion of the substrate 75 on the entrance side of the slot 70 on a substrate 75, and the connector 79 is mounted on the tip end portion of the substrate 75 in the insertion direction. A part of the interface component 78 and the connector 79 are exposed to the outside of the interface unit 71. A part of the interface component 78 is exposed as a connection port 78A shown in FIG. 14. As shown in FIG. 17, a connector 79 is partially exposed at the tip end portion of the interface unit 71.

As shown in FIGS. 16 and 17, the case 77 includes a metal section 77A made of sheet metal and a resin section 77B made of synthetic resin. For example, at least one of the front and rear surfaces of the case 77 is a metal section 77A, and the other section including the side portion of the case 77 is a resin section 77B. Since a part of the case 77 is made of sheet metal, the additional interface unit 71 has a function of blocking noise. The metal section 77A of the case 77 is exposed over a predetermined thickness.

Further, as shown in FIG. 15, a blindfolding partition plate 80, which makes it difficult to see a state in the adjacent slot 70, is integrally provided in one of the two lid members 73, each covering the adjacent slots 70 in the width direction Y. The partition plate 80 is disposed at a position close to the boundary with the adjacent slot 70 and partitions some or all of the two adjacent slots 70 in the width direction Y. The partition plate 80 is made of metal and has a function of blocking the noise of the interface unit 71 added to the adjacent slot 70.

Further, as shown in FIGS. 15 and 16, a connector 81 connectable to the connector 79 exposed at the tip end portion of the interface unit 71 is provided at the inner bottom section of the slot 70. A rail 82 capable of guiding the interface unit 71 or the lid member 73 in the depth direction X parallel to the axis of the slot 70 is provided on the inner wall portion of the slot 70. A pair of rails 82 is provided on both sides on the inner wall portion of the slot 70 in the vertical direction Z. As shown in FIG. 17, on the side portion of the interface unit 71, a protruding guide section 83 is formed so as to extend in the lengthwise direction thereof.

While being guided in the depth direction X by the engagement of the protruding guide section 83 with the groove section of the rail 82, the interface unit 71 is inserted straight into the slot 70. Further, while being guided in the depth direction X by the engagement of the partition plate 80 with the groove section of the rail 82, the lid member 73 is inserted straight into the slot 70. As compared with the configuration in which a dedicated partition member is provided for partitioning the slot 70, an integral provision of the partition plate 80 in the lid member 73 removes the need for a space to dispose an extra member such as a partition member, so that the space to dispose a plurality of slots 70 is kept small.

Figure 18:
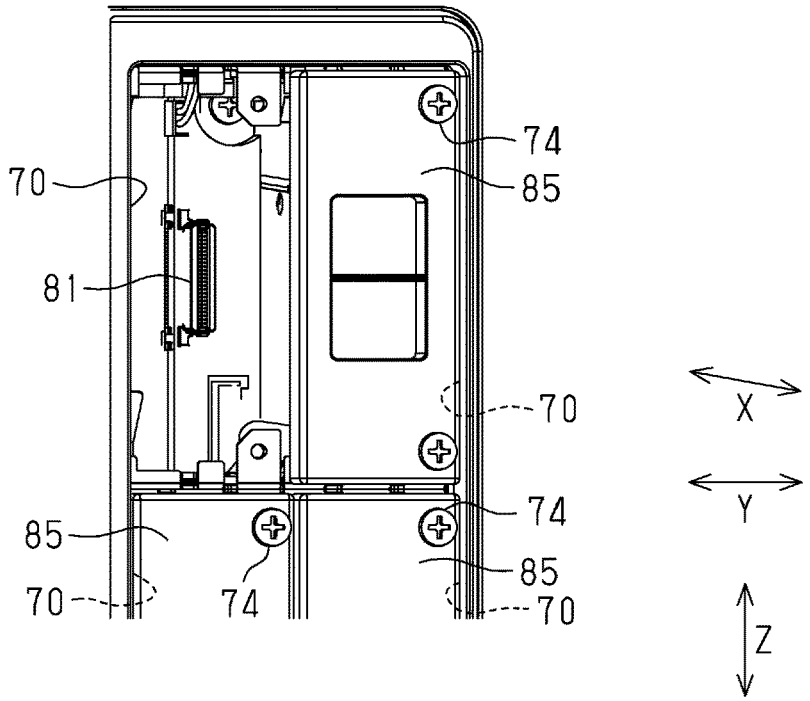
FIG. 18 is a perspective view showing a slot of a comparison example.
Figure 19:
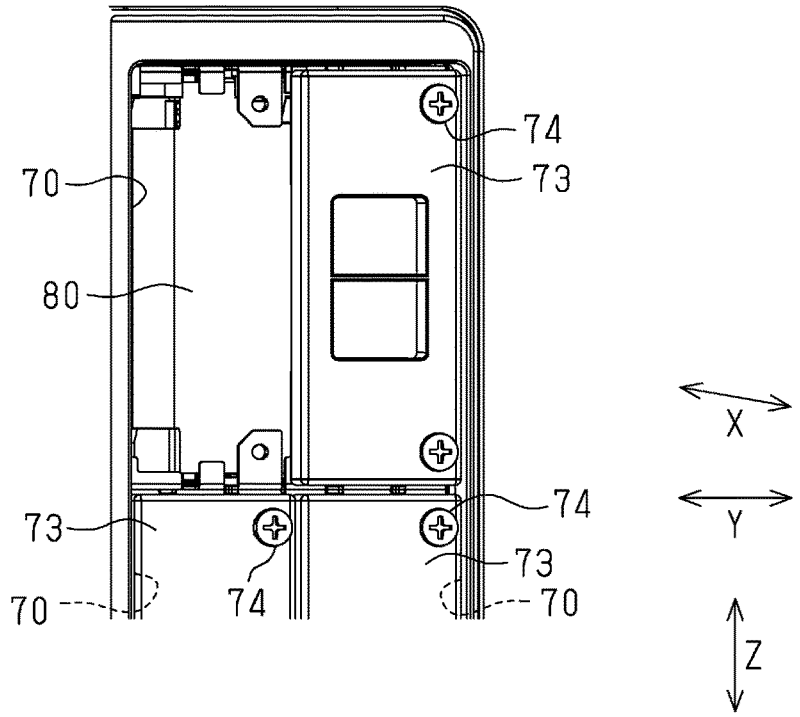
FIG. 19 is a perspective view showing a slot in accordance with the second embodiment.

FIG. 18 shows a lid member 85 of a comparison example without the partition plate 80, and FIG. 19 shows a lid member 73 of the present embodiment with the partition plate 80. For example, when an additional interface unit 71 is inserted into only one of the two slots 70 adjacent in the width direction Y, in the comparison example shown in FIG. 18, the state inside the adjacent slot 70 that includes the connector 81 positioned at the inner bottom portion of the adjacent slot 70 is visible if one lid member 85 is removed. In this case, the slot 70 looks bad and there is a concern that the adjacent slot 70 is damaged by a tool at the time of maintenance when the tool or the like is inserted into the slot 70.

On the other hand, in the embodiment, as shown in FIG. 19, even if one lid member 73 is removed, the two slots 70 are partitioned by the partition plate 80 inside, so that the state inside the adjacent slot 70 is not visible. In this case, the slot 70 looks good, and there is no concern that the adjacent slot 70 is damaged by a tool at the time of maintenance when the tool or the like is inserted into the slot 70.

Figure 20:
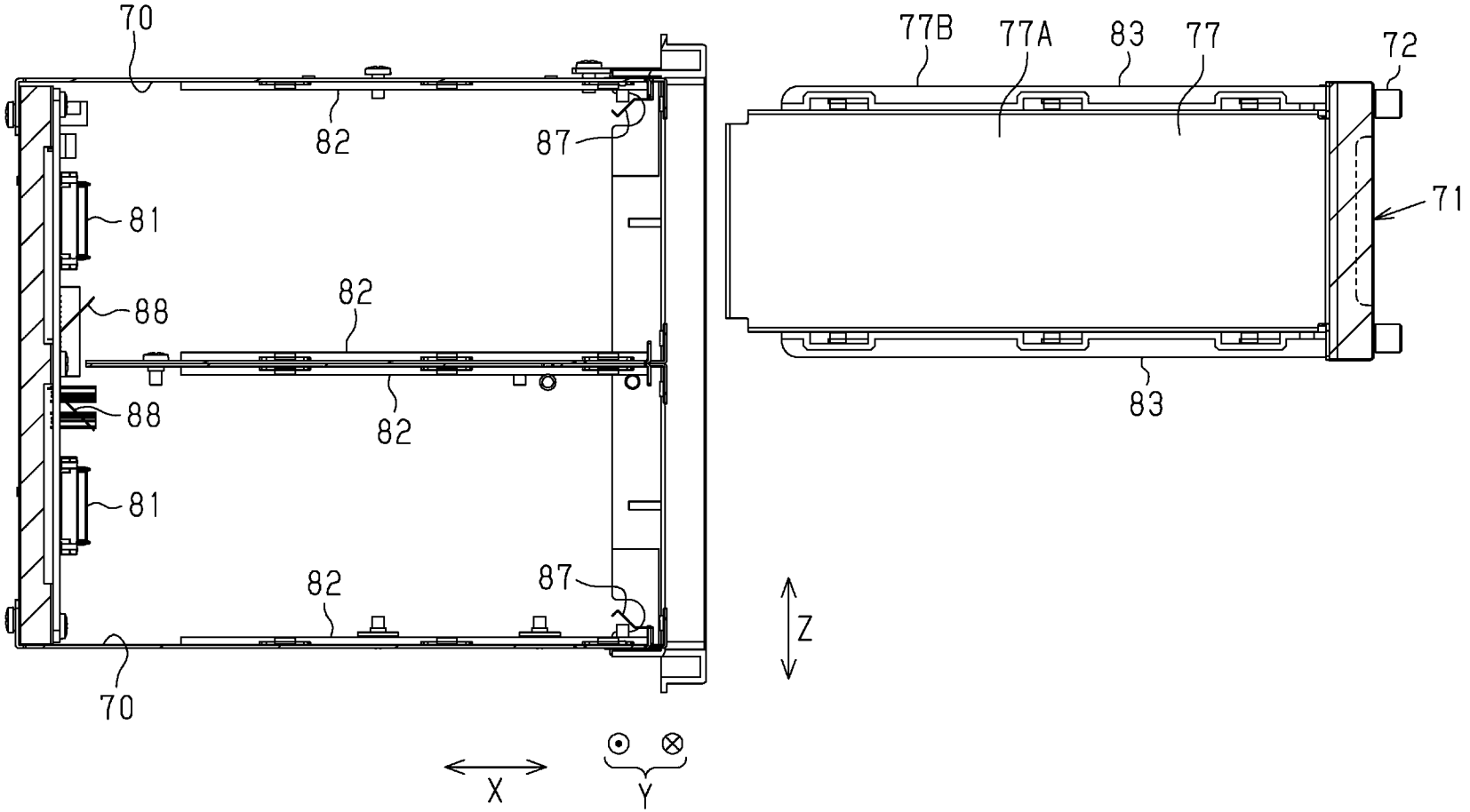
FIG. 20 is a side sectional view showing the interface unit and the slot.
Figure 21:
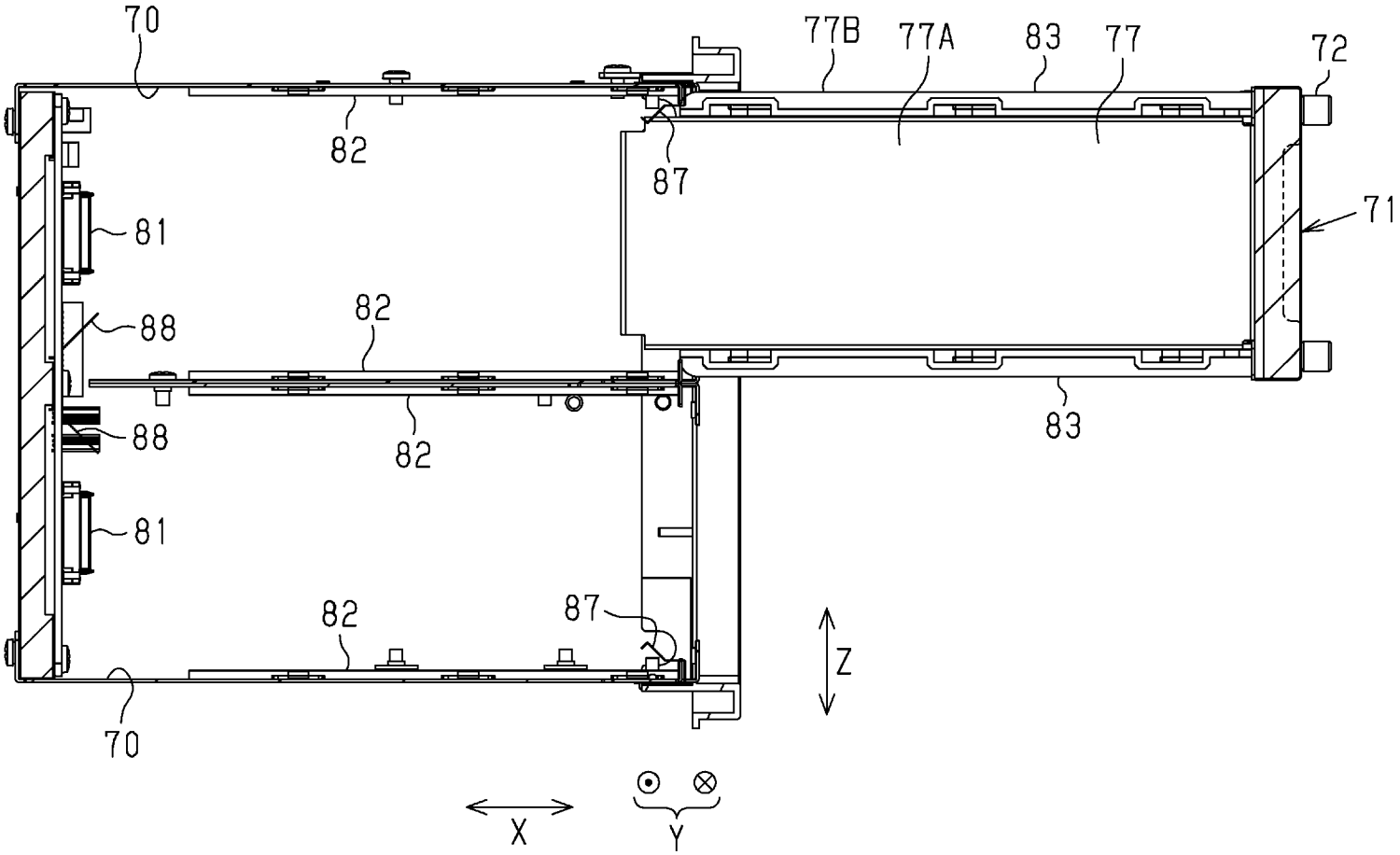
FIG. 21 is a side sectional view showing a state where the interface unit starts to be inserted into the slot.
Figure 22:
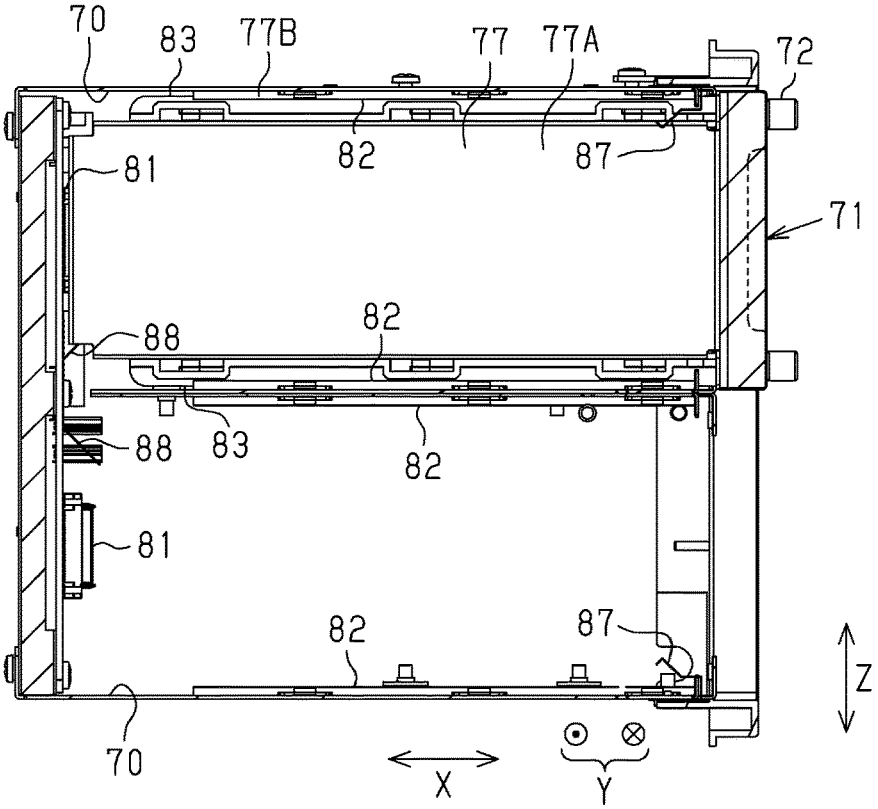
FIG. 22 is a side sectional view taken along the line XXII-XXII in FIG. 14 and showing a state where the interface unit is inserted into the slot.

Next, the grounding structure of the slot 70 will be described with reference to FIGS. 20 to 22. A first spring 87 for grounding made of metal is provided inside the plurality of slots 70 near the entrance as shown in FIG. 20. The first spring 87 is disposed at a position where the first spring 87 confronts the side surface of the metal section 77A of the case 77 when the interface unit 71 is inserted from the entrance of the slot 70 and protrudes further inside the slot 70 than the side surface of the metal section 77A in the vertical direction Z. Therefore, when the interface unit 71 starts to be inserted from the entrance of the slot 70, the side surface of the metal section 77A comes into contact with the first spring 87 (refer to FIG. 21). Further, a second spring 88 for grounding made of metal is provided on the inner bottom surface of the slot 70. When the insertion of interface unit 71 into the slot 70 comes to an end, the second spring 88 comes into contact with the metal section 77A, pressed against the tip end portion thereof to be deformed. In a state where the interface unit 71 is inserted into the slot 70, the metal section 77A is in contact with both the first spring 87 and the second spring 88. Further, the first spring 87 and the second spring 88 are grounded by an electrical connection to a metal frame (not shown).

As shown in FIG. 20, when the interface unit 71 is inserted into the slot 70, the lid member 73 is removed and the interface unit 71 is inserted into the slot 70. As shown in FIG. 21, when the tip end portion of the interface unit 71 starts to be inserted into the entrance of the slot 70, the first spring 87 positioned inside near the entrance comes into contact with the side surface of the metal section 77A made of sheet metal of the case 77. Then, in the course of insertion from an insertion start position shown in FIG. 21 to an insertion completion position shown in FIG. 22, the interface unit 71 slides the side surface of the metal section 77A made of a sheet metal of the case 77 against the first spring 87 so as to advance into the depth of the slot 70. Therefore, the interface unit 71 can be continuously grounded in the course of insertion of the interface unit 71 into the slot 70. When the insertion of the interface unit 71 into the slot 70 is completed, the metal section 77A exposed at the tip end portion of the case 77 comes into contact with the second spring 88. Therefore, when the interface unit 71 is in a state of insertion into the slot 70, the interface unit 71 is grounded in the vicinity of the entrance of the slot 70 by the contact with the first spring 87 and is grounded in the back of the slot 70 by the contact with the second spring 88.

Figure 23:
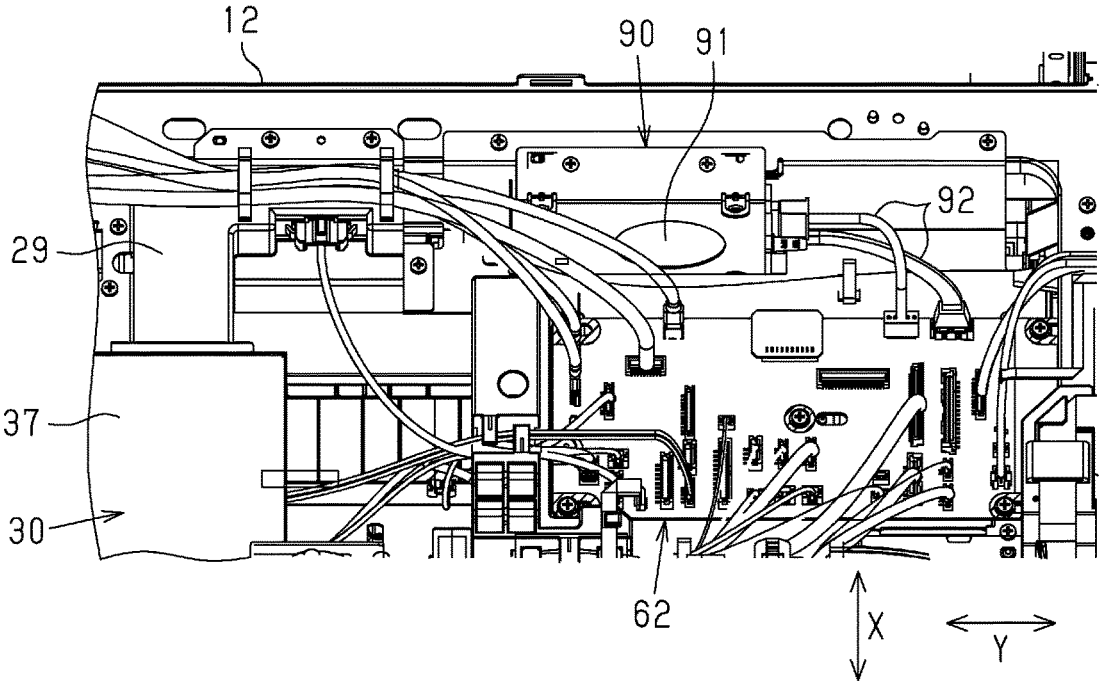
FIG. 23 is a perspective view showing a hard disk drive and a surrounding thereof.

Next, the disposition structure of the hard disk drive 90 will be described with reference to FIG. 23. As shown in FIG. 23, the hard disk drive 90 is disposed at a predetermined position in the casing 12. When the ink jet type printer 11 is moved, an impact is likely to occur in the vertical direction Z. Further, since the carriage 23 reciprocates in the width direction Y in the ink jet type printer 11 at the time of print operation, a vibration is generated in the width direction Y. Since the disk surface 91 is susceptible to an impact in the vertical direction, the hard disk drive 90 is installed in such a direction that the disk surface 91 parallel to the vertical direction Z which is the falling direction and the width direction Y which is the moving direction of the carriage 23.

Therefore, a drop impact is applied to the casing 12 when the ink jet type printer 11 is moved, or vibration is generated in the width direction Y by the reciprocation of the carriage 23 at the time of print operation of the ink jet type printer 11. Since the hard disk drive 90 is installed in such a direction that the disk surface 91, susceptible to an impact of the vertical direction, is parallel to the vertical direction Z which is the falling direction and the width direction Y which is the main scanning direction of the carriage 23, even if the hard disk drive 90 is subjected to this type of vibration, breakdown thereof hardly comes about.

Next, the operation of the ink jet type printer 11 of the second embodiment will be described.

When the fan 44 is driven, air is sucked in from the supply section 26. That is, air is taken into the casing 12 from the supply port 28 of the supply section 26. The air sucked in from the supply port 28 is sucked into the case 37 from the second opening 43 through the flow path 29. The air which is filtered by the filter 45 is sucked into the case 37 from the second opening 43. Since the pressure inside the case 37 gets lower than the pressure outside the case 37, the air inside the case 37 drifts out of the case 37 from the first opening 42 due to the pressure difference inside/outside the case 37. Therefore, the airflow is generated from the second opening 43 to the first opening 42 in the case 37. As a result, since the case 37 is ventilated well and the temperature in the case 37 goes down, the power supply unit 30 is cooled.

Since relatively clean air is sucked into the case 37, there is no concern of contamination by the ink mist or the like in the power supply unit 30. For example, when the configuration is such that the air is taken in from the front, the air intake port is on the moving region R side of the carriage 23, so that the filter disposed at the air intake port is clogged early by the ink mist or the like, as compared with the configuration in which the air intake port is disposed on the rear side. In other words, since the air intake port is disposed on the rear side, the filter is hard to clog as compared with the configuration in which the air intake port is disposed on the front side, and it is possible to suck in the necessary flow amount of the clean air with extremely little ink mist over a long period of time.

Further, as shown in FIGS. 10 and 11, the airflow sucked in from the fan 44 hits the rear surface of the heat sink 56 and drifts along the rear surface of the heat sink 56 to the side thereof. In this example, since the first opening 42 is on the second side surface 37*c* of the power supply unit 30, out of the airflow generated by the suction of the air from the fan 44, a part of the airflow that hits the rear surface of the heat sink 56 drifts along the rear surface of the heat sink 56 toward the first opening 42 and drifts along the rear surface of the other heat sink 56. Therefore, a plurality of heat sink 56 can be cooled effectively. As a result, the converter 55 which is a heat generating component in contact with the heat sink 56 can be cooled efficiently. Therefore, the heat generation of the power supply unit 30 can be suppressed effectively.

Further, since an opening or an air discharge hole also exists on the front surface 37*a* of the power supply unit 30, a part of the airflow sucked in from the fan 44 drifts above the heat sink 56 or through the gaps among heat sinks 56 forward in the power supply unit 30. As a result, the electronic component 38 mounted at a position in front of the heat sink 56 is also cooled by the airflow. Therefore, the electronic component 38 in the power supply unit 30 is cooled evenly regardless of the position in the depth direction X. Therefore, the heat generation of the power supply unit 30 can be suppressed effectively.

According to the second embodiment described above in detail, the following effect can be obtained.

(8) In the ink jet type printer 11, the power supply unit 30 has the fan 44 that sucks in the outside air from an opening. With this configuration, since the outside air is sucked into the power supply unit 30 from the opening by the driving of the fan 44, the inside of the power supply unit 30 can be cooled effectively. By the efficient cooling of the power supply substrate 54, the capacity of the power supply can be increased and the automatic document feeding device 14 and print operation of the ink jet type printer 11 can be sped up.

(9) The ink jet type printer 11 has the supply section 26 that supplies the paper sheet P as an example of a recording medium at the rear portion of the apparatus, an opening is disposed on the supply section 26 side, and the fan 44 sucks in the air from the supply section 26. Therefore, the air sucked in from the supply section 26 by the driving of the fan 44 can be sucked into the power supply unit 30 smoothly.

For example, in the case of a configuration in which the fan 44 is disposed on a side surface of the power supply unit 30, it is necessary to provide an opening from which the air is taken into the casing 12 on a side portion of the casing 12. In contrast, in the second embodiment, since the air can be taken in through the supply port 28 of the supply section 26 from which the paper sheet P is supplied, it is not necessary to provide an air intake port from which the air is taken in on a side portion or the like of the casing 12 separately.

(10) The power supply unit 30 accommodates the power supply substrate 54 on which the converter 55 which is a heat generating component and the heat sink 56 in contact with the converter 55 and the converter are mounted. The heat sink 56 is disposed along the surface on which the fan 44 is disposed. Therefore, since the airflow generated by the suction of the outside air from an opening into the power supply unit 30 by the driving of the fan 44 hits the heat sink 56, the heat sink 56 can be cooled efficiently. There the converter 55 which is a heat generating component in contact with the heat sink 56 can be cooled efficiently.

(11) A spring for grounding is provided at the entrance end portion of the slot 70. The additional interface unit 71 can be inserted into the slot 70 in a state of sliding in contact with the first spring 87 which is an example of a spring for grounding from the beginning to the end. Therefore, even if the user is charged with static electricity, the electric current flown by static electricity can be grounded through the first spring 87. Therefore, a failure of the interface unit 71 for an additional device by the static electricity can be avoided.

(12) The lid member 73 that closes the slot 70 includes a partition plate 80 that partitions the slot 70 from the adjacent slot 70. Therefore, when the user opens the lid member 73 of the slot 70 at the time of adding an additional interface unit 71, the inside of the adjacent slot 70 is not visible. For example, the user can avoid inserting a finger in the adjacent slot 70. Further, since the partition plate 80 is made of metal, the noise from the additional interface unit 71 inserted into the adjacent slot 70 can be blocked.

(13) The main substrate 61 and the relay substrate 62 are connected to each other by the connectors 64C and 66C, and the wire such as the flexible flat cable connecting the substrates 61 and 62 is eliminated. When the relay substrate 62 is fixed with the screw 68 through the elongated hole 69 and the relay substrate 62 is moved aside in the second direction Y2 by loosening the screw 68, the main substrate 61 can be removed.

(14) The hard disk drive 90 is disposed in such a direction that both the vertical direction Z and the width direction Y are perpendicular to the disk surface 91. Thus, even when the hard disk drive 90 is subjected to an impact caused by a fall of the ink jet type printer 11 or a vibration caused by the reciprocation of the carriage 23 in the width direction Y at the time of print operation, the failure of the hard disk drive 90 hardly comes about.

The embodiment described above can be modified into such a form as the modification example shown below. Further, a combination of the embodiment described above and the modification examples shown below as deemed appropriate can serve as a further modification example, and a combination of the modification examples shown below as deemed appropriate can serve as a further modification example.

Figure 24:
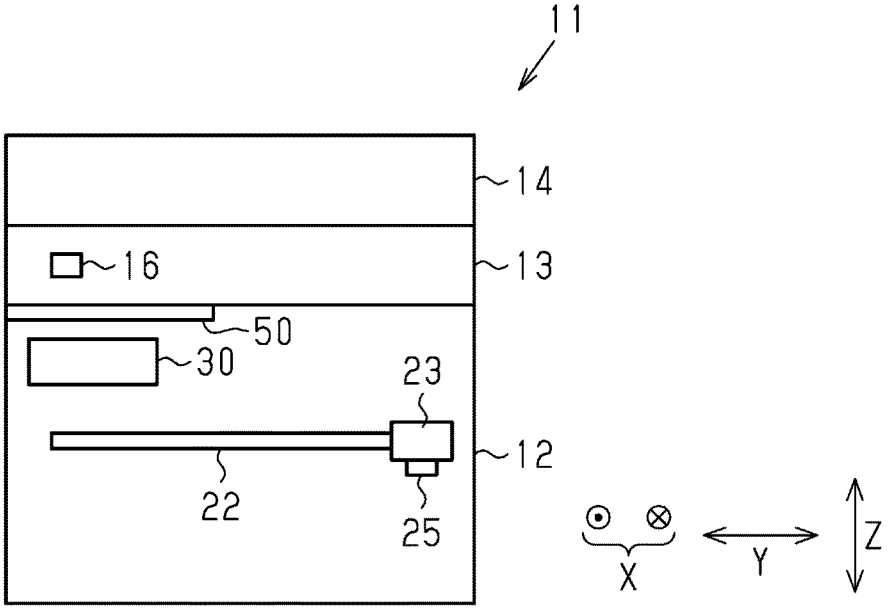
FIG. 24 is a front schematic view showing an ink jet type printer of a modification example.

As shown in FIG. 24, a heat insulation member 50 may be disposed between the power supply unit 30 and the image reading section 16. This is because the image reading section 16 disposed in the document reading device 13 is often disposed above the power supply unit 30. That is, the reading position of the image reading section 16 at the time the document G is transported and read and the standby position of the image reading section 16 at the time the placed document G is read are often set above the power supply unit 30 as shown in FIG. 22. The heat insulation member 50 is configured with a foam material, for example. In this way, since the transmission of the heat generated by the power supply unit 30 to the image reading section 16 can be suppressed by the heat insulation member 50, the exertion of an adverse impact of the heat generated by the power supply unit 30 on the image reading section 16 can be suppressed. In this case, the heat insulation member 50 may be directly plastered to the upper surface 37*d* of the case 37 of the power supply unit 30.

Figure 25:
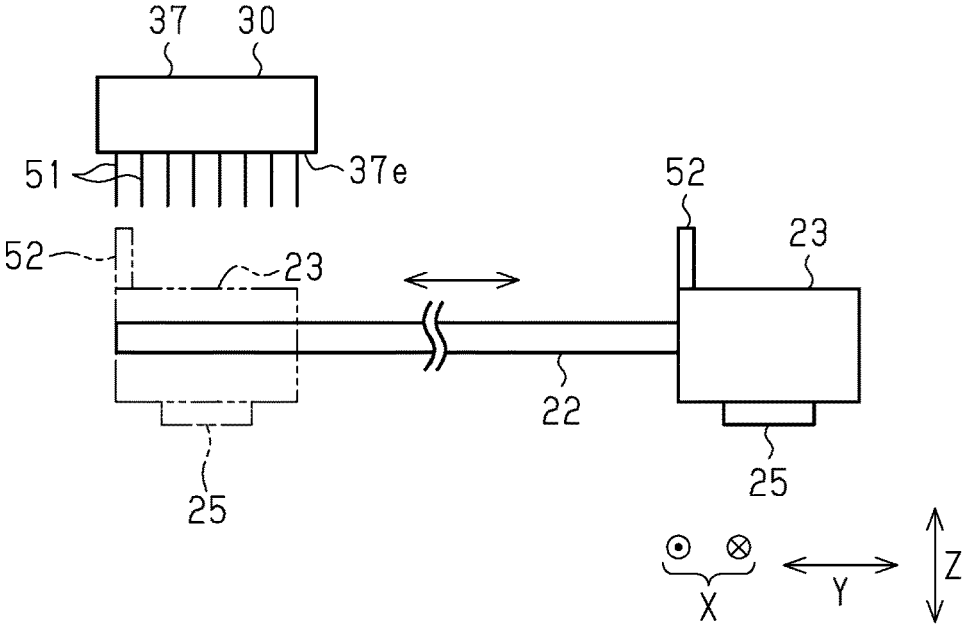
FIG. 25 is a front schematic view showing a major portion of the ink jet type printer of the modification example.

As shown in FIG. 25, a heat dissipation section 51 that dissipates the heat generated by the power supply unit 30 may be provided on the lower surface 37*e* of the case 37 of the power supply unit 30. The heat dissipation section 51 is configured with a plurality of heat dissipating fins made of a material having high thermal conductivity such as aluminum or the like, for example. In this way, since the heat dissipation section 51 is subjected to the wind generated by the movement of the carriage 23, the heat dissipation efficiency of the power supply unit 30 can be improved.

As shown in FIG. 25, a plate-shaped rib 52 extending in a direction (depth direction Y in this example) intersecting with the width direction Y in which the carriage 23 moves may be provided at an upper end portion of the carriage 23. With this configuration, the stir efficiency of the air by the movement of the carriage 23 can be improved. Therefore, the temperature of the air around the power supply unit 30 can be lowered, and the power supply unit 30 can be cooled effectively. Additionally, the combined use of both the rib 52 and the heat dissipation section 51 described above can cool the power supply unit 30 more effectively.

Figure 26:
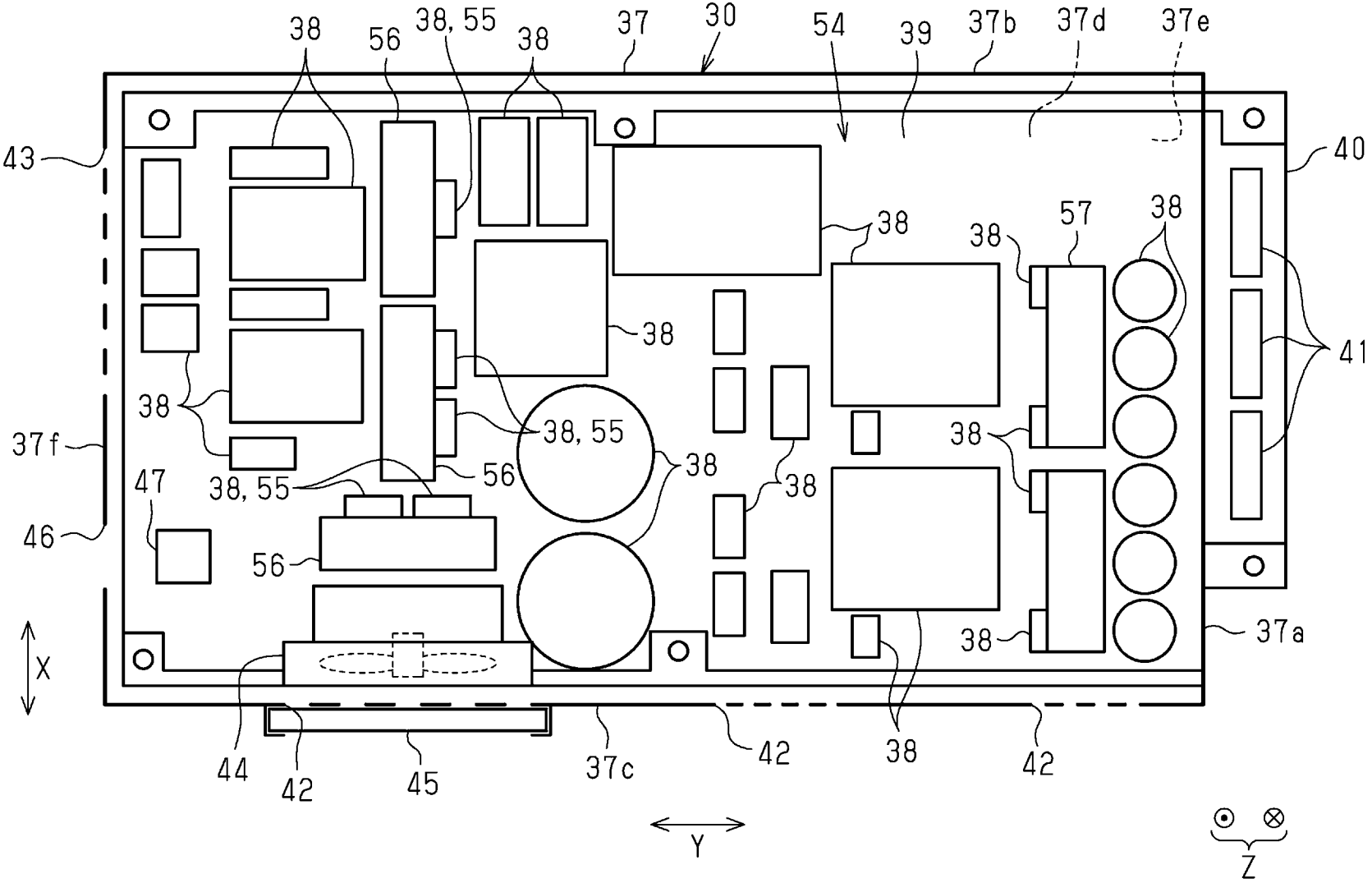
FIG. 26 is a plan view with an upper surface of the power supply unit of the modification example removed.

The position of the fan 44 that sucks in the outside air into the power supply unit 30 is not limited to the rear surface 37*f* which is a position on the supply section 26 side as shown in FIGS. 10 and 11, but can be changed to other positions as deemed appropriate. For example, as shown in FIG. 26, the fan 44 may be disposed on the second side surface 37*c* of the power supply unit 30. In this case, the fan 44 suck in the air from the first opening 42 formed on the second side surface 37*c* of the power supply unit 30. In the example shown in FIG. 26, the power supply unit 30 accommodates the power supply substrate 54 on which the converter 55 which is a heat generating component and the heat sink 56 in contact with the converter 55 are mounted. The heat sink 56 is disposed along the second side surface 37*c* on which the fan 44 is disposed. In this case, as shown in FIG. 26, in an example where there are a plurality of the heat sinks 56, the disposition of one heat sink 56 along the second side surface 37*c* on which the fan 44 is disposed is sufficient. Further, in the example shown in FIG. 26, the heat sink 56 disposed at a position where the heat sink 56 faces the fan 44 such that the first side on which fins and recessed grooves (not shown) are formed faces the fan 44 and the converter 55 is mounted in contact with the second surface, which is the surface opposite to the first surface. The airflow generated by the suction of the outside air into the case 37 by the fan 44 hits the first surface of one heat sink 56 facing the fan 44 and then a part of the airflow drifts along the other heat sink 56 disposed on the second surface side of the heat sink 56. Further, the second opening 43 formed on the rear surface 37*f* of the case 37, the first opening 42 other than the one used as a suction port of the fan 44 out of the first openings 42 formed on the second side surface 37*c*, and the gap or the opening as in the second embodiment formed on the front surface 37*a* serve as air discharge ports. The electronic component 38 in the case 37 is cooled efficiently by the airflow drifting from the fan 44 toward each air discharge port.

The fan 44 of the power supply unit 30 may be omitted.

An opening for communicating with the outside of the case 37 may be provided on a surface other than the second side surface 37*c* and the rear surface 37*f* in the case 37 of the power supply unit 30.

The lower surface 37*e* and the first side surface 37*b* of the case 37 of the power supply unit 30 does not need to be shielded.

The power supply unit 30 does not necessarily need to be disposed at a position where the power supply unit 30 does not overlap with the standby position HP of the carriage 23 in the vertical direction Z.

The tube 33 does not necessarily need to curve downward and be connected to the carriage 23 after passing below the power supply unit 30 and passing through the height position the upper end of the power supply unit 30.

The tube 33 does not necessarily need to pass below the power supply unit 30 and supply ink to the recording head 25.

The casing 12 and the power supply unit 30 may be configured such that the air outside the casing 12 is sucked from the second opening 43.

The fan 44 may be disposed inside the second opening 43 in the case 37 and the filter 45 may be freely attachably/detachably disposed outside the first opening 42 in the case 37 in the power supply unit 30.

The recording medium is not limited to the paper sheet P but may be a flexible plastic film or the like.

Hereinafter, the technical concepts grasped from the embodiment and modification example will be described together with the effect.

The recording apparatus includes a recording head that performs recording on a recording medium by ejecting a liquid, a carriage that reciprocates in one direction while supporting the recording head, and a power supply unit that supplies electricity to driving targets including a driving source of the carriage and the recording head. A power supply unit is disposed such that at least a part thereof overlaps with a moving region of the carriage on the upper side.

With this configuration, since the power supply unit is disposed at a position higher than the carriage, when a liquid leaks from the carriage, the penetration of the leaking liquid into the power supply unit can be suppressed.

The recording apparatus includes a liquid supply path through which the liquid is supplied to the recording head from below the moving region, and the liquid supply path may pass below the power supply unit and supply the liquid to the recording head.

With this configuration, when a liquid leaks from the liquid supply path, the penetration of the leaking liquid into the power supply unit can be suppressed.

In the recording apparatus described above, the liquid supply path may curve downward and be connected to the carriage after passing below the power supply unit and passing the height position of the upper end of the power supply unit.

With this configuration, when the liquid supply path is configured with a flexible tube, the curvature of the tube can be reduced. Therefore, since the load applied to the tube can be reduced, the life of the tube can be extended.

In the recording apparatus described above, the power supply unit may be disposed at a position where the power supply unit does not overlap with the standby position of the carriage in the vertical direction.

With this configuration, the exertion of an adverse impact of the heat generated by the power supply unit on the recording head standing by at the standby position of the carriage can be suppressed.

In the recording apparatus described above, the image reading section that reads the image of the document may be disposed above the power supply unit, and the heat insulation member may be disposed between the power supply unit and the image reading section.

With this configuration, since the transmission of the heat generated by a power supply unit to the image reading section can be suppressed by a heat insulation member, the exertion of an adverse impact of the heat generated by the power supply unit on the image reading section can be suppressed.

In the recording apparatus described above, a heat dissipation section that dissipates the heat generated by the power supply unit may be provided on a lower surface of the power supply unit.

With this configuration, the heat dissipation efficiency of the power supply unit can be improved.

In the recording apparatus described above, a rib extending in a direction that intersects with the one direction may be provided at the upper end portion of the carriage.

With this configuration, since the stir efficiency of the air by the movement of the carriage can be improved, the rise of the ambient temperature of the power supply unit can be suppressed.

In the recording apparatus, the power supply unit may be disposed at a position where the power supply unit confronts an end portion of the moving region of the carriage in the one direction and at least a lower surface and a side surface on the center portion side of the moving region of the carriage in the one direction may be shielded.

With this configuration, the penetration of the mist of the liquid ejected from the recording head into the power supply unit can be suppressed.

In the recording apparatus described above, the power supply unit may have an opening for communicating with the outside on a surface other than the shielded surface.

With this configuration, the penetration of the mist of the liquid into the power supply unit can be suppressed while the ventilation in the power supply unit is secured.

In the recording apparatus described above, the power supply unit may have a fan that discharges the inside air to the outside from the opening.

With this configuration, the power supply unit can be cooled by the driving of the fan.

In the recording apparatus described above, the power supply unit may have a fan that sucks in the outside air from the opening.

With this configuration, since the outside air is sucked into the power supply unit from the opening by the driving of the fan, the inside of the power supply unit can be cooled effectively.

In the recording apparatus described above, the recording apparatus may have a supply section that supplies the recording medium to the recording medium at the rear portion of the apparatus, the opening may be disposed on the supply section side, and the fan may suck in the air from the supply section.

With this configuration, since the supply port through which the recording medium is supplied is positioned on the supply section side, the outside air can be smoothly sucked from the supply section into the power supply unit by the driving of the fan.

In the recording apparatus described above, the power supply unit may accommodate a power supply substrate on which a heat sink which connects a converter which is a heat generating component inside to the converter is mounted, and the heat sink may be disposed along a surface on which the fan is disposed in the power supply unit.

With this configuration, since the airflow generated by the suction of the outside air from the opening into the power supply unit by the driving of the fan hits the heat sink, the heat sink can be cooled efficiently. Therefore, the converter which is a heat generating component in contact with the heat sink can be cooled efficiently.

What is claimed is:

1. A recording apparatus comprising:

a recording head that performs recording on a recording medium by ejecting a liquid;

a carriage that reciprocates in one direction while supporting the recording head; and a power supply unit that supplies electricity to driving targets including a driving source of the carriage and the recording head, wherein the power supply unit is disposed such that at least a part thereof overlaps above in a vertical direction with a moving region of the carriage such that the moving direction is below the at least part of the power supply unit in the vertical direction.

2. The recording apparatus according to claim 1, further comprising:

a liquid supply path through which the liquid is supplied from below the moving region to the recording head, wherein the liquid supply path passes below the power supply unit and causes the liquid to be supplied to the recording head.

3. The recording apparatus according to claim 2, wherein the liquid supply path curves downward and is connected to the carriage after passing below the power supply unit and passing a height position at an upper end of the power supply unit.

4. The recording apparatus according to claim 1, wherein the power supply unit is disposed at a position where the power supply unit does not overlap with a standby position of the carriage in a vertical direction.

5. The recording apparatus according to claim 1, wherein an image reading section that reads an image of a document is disposed above the power supply unit, and wherein a heat insulation member is disposed between the power supply unit and the image reading section.

6. The recording apparatus according to claim 1, wherein a heat dissipation section that dissipates heat generated in the power supply unit is disposed on a lower surface of the power supply unit.

7. The recording apparatus according to claim 1, wherein a rib extending in a direction that intersects with the one direction is provided at an upper end portion of the carriage.

8. The recording apparatus according to claim 1, wherein the power supply unit is disposed at a position where the power supply unit corresponds to an end portion of the moving region of the carriage in the one direction, and at least a lower surface and a side surface on a center portion side of the moving region of the carriage in the one direction are shielded.

9. The recording apparatus according to claim 8, wherein the power supply unit has an opening for communicating with an outside on a surface other than the shielded surface.

10. The recording apparatus according to claim 9, wherein the power supply unit has a fan that discharges inside air to the outside from the opening.

11. The recording apparatus according to claim 9, wherein the power supply unit has a fan that sucks in outside air from the opening.

12. The recording apparatus according to claim 11, further comprising:

a supply section that supplies the recording medium at a rear portion of the apparatus, wherein the opening is disposed on the supply section side and the fan sucks in air from the supply section.

13. The recording apparatus according to claim 11, wherein the power supply unit accommodates a power supply substrate mounted with a converter which is a heat generating component and a heat sink which is in contact with the converter, and wherein the heat sink is disposed along a surface on which the fan is disposed in the power supply unit.

* * * * *